US010806305B2

(12) United States Patent
Yang et al.

(10) Patent No.: US 10,806,305 B2
(45) Date of Patent: Oct. 20, 2020

(54) SOAP PUMP

(71) Applicant: simplehuman, LLC, Torrance, CA (US)

(72) Inventors: Frank Yang, Rancho Palos Verdes, CA (US); Guy Cohen, Marina Del Rey, CA (US); Zachary Rapoport, Northridge, CA (US); Hon-Lun Chen, Irvine, CA (US); Eric Beaupre, Los Angeles, CA (US); Sachin Kumar, Bangalore (IN); Chetan Machakanoor, Bangalore (IN); Varun Sundar, Bangalore (IN)

(73) Assignee: simplehuman, LLC, Torrance, CA (US)

( * ) Notice: Subject to any disclaimer, the term of this patent is extended or adjusted under 35 U.S.C. 154(b) by 0 days.

(21) Appl. No.: 15/922,227

(22) Filed: Mar. 15, 2018

(65) Prior Publication Data

US 2018/0263432 A1 Sep. 20, 2018

Related U.S. Application Data

(60) Provisional application No. 62/472,855, filed on Mar. 17, 2017.

(51) Int. Cl.
*A47K 5/12* (2006.01)

(52) U.S. Cl.
CPC ..... *A47K 5/1217* (2013.01); *A47K 5/1215* (2013.01); *A47K 5/1211* (2013.01); *A47K 2005/1218* (2013.01)

(58) Field of Classification Search
CPC ..... A47K 5/1217; A47K 5/1215; A47K 2005/1218; A47K 5/1211
See application file for complete search history.

(56) References Cited

U.S. PATENT DOCUMENTS 2,017,867 A 10/1935 Nantz
2,106,043 A 1/1938 Urquhart et al.
(Continued)

FOREIGN PATENT DOCUMENTS

CN 1285899 A 2/2001
CN 101606828 A 12/2009
(Continued)

OTHER PUBLICATIONS

U.S. Appl. No. 29/587,080, filed Dec. 9, 2016, Yang et al.
(Continued)

*Primary Examiner* — David P Angwin
*Assistant Examiner* — Bob Zadeh
(74) *Attorney, Agent, or Firm* — Knobbe, Martens, Olson & Bear, LLP

(57) ABSTRACT

Various soap dispensers are disclosed. Certain embodiments include a housing, reservoir, pump, motor, sensor, electronic processor, and nozzle. In some embodiments, the pump comprises a peristaltic pump. In certain embodiments, the sensor can be configured to generate a signal based on a distance between an object and the sensor. In certain embodiments, the electronic processor can be configured to receive the signal from the sensor and to determine a dispensation volume of the liquid, such as based on the distance between the object and the sensor. The processor can be configured to control the motor to dispense approximately the dispensation volume of the liquid.

29 Claims, 17 Drawing Sheets

(56) References Cited

U.S. PATENT DOCUMENTS 2,651,545 A 9/1953 Shotton
2,697,446 A 12/1954 Harrington
2,772,817 A 12/1956 Jauch
3,023,922 A 3/1962 Arrington et al.
3,149,754 A 9/1964 Kogan et al.
3,220,954 A 11/1965 Malbe
3,531,021 A * 9/1970 Bassett ..... A47K 5/1215 200/81.9 R
3,631,736 A 1/1972 Saari
3,701,482 A 10/1972 Sachnik
4,046,289 A 9/1977 Teranishi
4,056,050 A 11/1977 Brown
4,113,147 A 9/1978 Frazier et al.
4,202,387 A 5/1980 Upton
4,217,993 A 8/1980 Jess et al.
4,457,455 A 7/1984 Meshberg
4,498,843 A 2/1985 Schneider et al.
4,524,805 A 6/1985 Hoffman
4,693,854 A 9/1987 Yau
4,722,372 A 2/1988 Hoffman et al.
4,801,249 A 1/1989 Kakizawa
4,915,347 A 4/1990 Iqbal et al.
4,921,131 A 5/1990 Binderbauer et al.
4,938,384 A 7/1990 Pilolla
4,946,070 A 8/1990 Albert et al.
4,967,935 A 11/1990 Celest
5,028,328 A 7/1991 Long
5,082,150 A 1/1992 Steiner et al.
5,105,992 A * 4/1992 Fender ..... A47K 5/1217 222/181.2
5,169,040 A 12/1992 Wiley
5,186,360 A 2/1993 Mease et al.
5,199,118 A 4/1993 Cole et al.
5,255,822 A 10/1993 Mease et al.
5,271,528 A 12/1993 Chien
5,305,916 A 4/1994 Suzuki et al.
5,449,280 A 9/1995 Maki et al.
5,466,131 A 11/1995 Altham et al.
5,472,719 A 12/1995 Favre
5,477,984 A 12/1995 Sayama et al.
5,509,578 A 4/1996 Livingstone
5,632,414 A 5/1997 Merriweather, Jr.
5,771,925 A 6/1998 Lewandowski
5,823,390 A 10/1998 Muderlak et al.
5,829,636 A 11/1998 Vuong et al.
5,836,482 A 11/1998 Ophardt et al.
5,855,356 A 1/1999 Fait
5,868,311 A 2/1999 Cretu-petra
5,960,991 A 10/1999 Ophardt
D416,154 S 11/1999 Diehl
5,988,451 A 11/1999 Hanna
6,021,705 A 2/2000 Dijs
6,021,960 A 2/2000 Kehat
6,036,056 A 3/2000 Lee et al.
6,048,183 A 4/2000 Meza
D426,093 S 6/2000 Cayouette
D426,413 S 6/2000 Kreitemier et al.
6,126,290 A 10/2000 Veigel
D433,944 S 11/2000 Bernard
6,142,340 A * 11/2000 Watanabe ..... B67D 1/0007 222/129.3
D438,041 S 2/2001 Huang
6,209,752 B1 4/2001 Mitchell et al.
RE37,173 E 5/2001 Jefferson, Jr. et al.
6,269,735 B1 8/2001 Rolfes
6,279,460 B1 8/2001 Pope
6,279,777 B1 8/2001 Goodin et al.
6,311,868 B1 11/2001 Krietemeier et al.
6,325,604 B1 12/2001 Du
6,375,038 B1 4/2002 Daansen et al.
6,390,329 B1 5/2002 Maddox
6,443,328 B1 9/2002 Fehl et al.
6,444,956 B1 9/2002 Witcher et al.
D471,047 S 3/2003 Gordon et al.
6,557,584 B1 5/2003 Lucas et al.
6,594,105 B1 7/2003 Brittner
D477,956 S 8/2003 Grisdale et al.
6,619,938 B2 9/2003 Woodruff
D483,974 S 12/2003 Reed
D484,573 S 12/2003 Haug et al.
D486,335 S 2/2004 Sonneman
6,698,616 B2 3/2004 Hidle et al.
6,722,265 B2 4/2004 Priley
D490,262 S 5/2004 Graves et al.
6,748,850 B1 6/2004 Kraan
6,777,007 B2 8/2004 Cai
6,805,042 B2 10/2004 Mordini et al.
6,824,369 B2 11/2004 Raymond
D499,295 S 12/2004 Grisdale et al.
6,832,542 B2 12/2004 Hu et al.
6,892,899 B2 5/2005 Minard et al.
6,929,150 B2 8/2005 Muderlak et al.
6,971,549 B2 12/2005 Leifheit et al.
7,008,073 B2 3/2006 Stuhlmacher
D530,954 S 10/2006 Snell
D531,440 S 11/2006 Lo
D531,441 S 11/2006 Soriano
D531,845 S 11/2006 Christianson
D534,753 S 1/2007 Christianson
7,178,746 B2 2/2007 Gross
7,213,593 B2 5/2007 Hochrainer
D554,412 S 11/2007 Yang et al.
7,296,765 B2 11/2007 Rodrian
D560,942 S 2/2008 Hanna
D564,273 S 3/2008 Yang et al.
7,337,635 B2 3/2008 Cerruti et al.
D565,878 S 4/2008 Krus
7,354,015 B2 4/2008 Byrd et al.
D581,193 S 11/2008 Ghiorghie
D582,187 S 12/2008 Yang et al.
7,479,000 B2 1/2009 Klassen
D593,784 S 6/2009 Chan
7,540,397 B2 6/2009 Muderlak et al.
D604,544 S 11/2009 Daams
7,637,893 B2 12/2009 Christensen et al.
D608,578 S 1/2010 Yang et al.
D622,991 S 9/2010 MacDonald et al.
D626,365 S 11/2010 Yang et al.
D644,523 S 9/2011 Howell et al.
D644,529 S 9/2011 Padain et al.
D644,530 S 9/2011 Padain et al.
D644,531 S 9/2011 Padain et al.
8,087,543 B2 1/2012 Yang et al.
8,096,445 B2 1/2012 Yang et al.
8,109,301 B1 2/2012 Denise
8,109,411 B2 2/2012 Yang et al.
8,152,027 B1 4/2012 Baker
D658,915 S 5/2012 Fernandes et al.
D659,452 S 5/2012 Yang et al.
D659,454 S 5/2012 Fritz et al.
D660,061 S 5/2012 Fernandes et al.
D661,531 S 6/2012 Tompkin
D661,933 S 6/2012 Delgigante et al.
D663,983 S 7/2012 Yang et al.
D664,387 S 7/2012 Kennedy
D672,177 S 12/2012 Zeng
D674,636 S 1/2013 Yang et al.
8,360,285 B2 1/2013 Grbesic
D676,116 S 2/2013 Judd
D682,589 S 5/2013 Cheng
D688,488 S 8/2013 Wang
D689,299 S 9/2013 Kassem Llano et al.
D690,129 S 9/2013 Clough et al.
D690,130 S 9/2013 Clough et al.
D690,131 S 9/2013 Clough et al.
D690,530 S 10/2013 Clough et al.
8,550,378 B2 10/2013 Mazooji et al.
D693,597 S 11/2013 Yang et al.
D699,047 S 2/2014 Lissoni
D699,475 S 2/2014 Yang et al.
D699,574 S 2/2014 Cox et al.
8,662,356 B2 3/2014 Padain et al.
8,678,244 B2 3/2014 Yang et al.
D706,549 S 6/2014 Cho

(56) References Cited

U.S. PATENT DOCUMENTS

| | | | | |
|---|---|---|---|---|
| D717,066 | S | 11/2014 | Deacon | |
| 8,893,928 | B2 | 11/2014 | Proper | |
| D721,279 | S | 1/2015 | Van Handel et al. | |
| D727,653 | S | 4/2015 | Bjerre-Poulsen et al. | |
| D731,203 | S | 6/2015 | Watson et al. | |
| D731,204 | S | 6/2015 | Watson et al. | |
| D732,308 | S | 6/2015 | Enga et al. | |
| D746,136 | S | 12/2015 | Liu | |
| 9,265,383 | B2 | 2/2016 | Yang et al. | |
| 9,375,741 | B2 * | 6/2016 | Turner | A61L 2/18 |
| D770,798 | S | 11/2016 | Yang et al. | |
| D773,847 | S | 12/2016 | Judd | |
| D773,848 | S | 12/2016 | Yang et al. | |
| D785,970 | S | 5/2017 | Yang et al. | |
| D786,579 | S | 5/2017 | Beck et al. | |
| 9,763,546 | B2 | 9/2017 | Yang et al. | |
| D818,741 | S | 5/2018 | Yang et al. | |
| 10,076,216 | B2 | 9/2018 | Yang et al. | |
| D829,465 | S | 10/2018 | Yang et al. | |
| 2002/0179643 | A1 | 12/2002 | Knight et al. | |
| 2002/0185002 | A1 | 12/2002 | Herrmann | |
| 2003/0068242 | A1 | 4/2003 | Yamakawa | |
| 2004/0032749 | A1 | 2/2004 | Schindler et al. | |
| 2004/0050875 | A1 | 3/2004 | Kobayashi | |
| 2004/0077187 | A1 * | 4/2004 | Belongia | H01R 13/6205 439/39 |
| 2004/0103792 | A1 | 6/2004 | Cirigliano et al. | |
| 2004/0134924 | A1 | 7/2004 | Hansen et al. | |
| 2004/0226962 | A1 | 11/2004 | Mazursky et al. | |
| 2005/0006407 | A1 | 1/2005 | Lawson et al. | |
| 2005/0139612 | A1 | 6/2005 | Matthews et al. | |
| 2006/0067546 | A1 | 3/2006 | Lewis et al. | |
| 2006/0173576 | A1 | 8/2006 | Goerg et al. | |
| 2006/0243740 | A1 | 11/2006 | Reynolds et al. | |
| 2007/0000941 | A1 | 1/2007 | Hadden et al. | |
| 2007/0138202 | A1 * | 6/2007 | Evers | A47J 47/01 222/95 |
| 2007/0138208 | A1 | 6/2007 | Scholz et al. | |
| 2007/0158359 | A1 | 7/2007 | Rodrian | |
| 2007/0274853 | A1 | 11/2007 | Merendeiro et al. | |
| 2008/0149669 | A1 * | 6/2008 | Nicholson | B67D 1/0025 222/129.1 |
| 2008/0277411 | A1 | 11/2008 | Beland et al. | |
| 2008/0277421 | A1 | 11/2008 | Zlatic et al. | |
| 2008/0283556 | A1 | 11/2008 | Snodgrass | |
| 2009/0026225 | A1 | 1/2009 | Lickstein | |
| 2009/0088836 | A1 | 4/2009 | Bishop et al. | |
| 2009/0140004 | A1 | 6/2009 | Scorgie | |
| 2009/0184134 | A1 | 7/2009 | Ciavarella et al. | |
| 2009/0200340 | A1 | 8/2009 | Ophardt et al. | |
| 2010/0031982 | A1 | 2/2010 | Hornsby et al. | |
| 2010/0051642 | A1 | 3/2010 | Wong et al. | |
| 2010/0282772 | A1 | 11/2010 | Ionidis | |
| 2010/0320227 | A1 * | 12/2010 | Reynolds | A47K 5/1217 222/52 |
| 2011/0017769 | A1 | 1/2011 | Ophardt | |
| 2011/0114669 | A1 | 5/2011 | Yang et al. | |
| 2012/0111895 | A1 * | 5/2012 | Fitzpatrick | A47K 5/1209 222/214 |
| 2012/0138632 | A1 | 6/2012 | Li et al. | |
| 2012/0138637 | A1 | 6/2012 | Ciavarella et al. | |
| 2012/0248149 | A1 * | 10/2012 | Pelfrey | B67D 1/108 222/214 |
| 2012/0285992 | A1 * | 11/2012 | Ciavarella | F04C 13/00 222/138 |
| 2012/0318820 | A1 | 12/2012 | Amsel et al. | |
| 2013/0119083 | A1 * | 5/2013 | Ophardt | A47K 5/1204 222/64 |
| 2013/0140323 | A1 | 6/2013 | Yun et al. | |
| 2013/0200097 | A1 * | 8/2013 | Yang | A47K 5/1217 222/52 |
| 2013/0200109 | A1 | 8/2013 | Yang et al. | |
| 2013/0214011 | A1 | 8/2013 | Vandekerchkhove et al. | |
| 2014/0103072 | A1 | 4/2014 | Pelfrey | |
| 2014/0137982 | A1 | 5/2014 | Nicholls et al. | |
| 2015/0265106 | A1 | 9/2015 | Rospierski | |
| 2016/0256016 | A1 | 9/2016 | Yang et al. | |
| 2017/0015541 | A1 * | 1/2017 | Vulpitta | B67D 1/0001 |
| 2018/0220850 | A1 | 8/2018 | Yang et al. | |
| 2018/0263432 | A1 * | 9/2018 | Yang | A47K 5/1215 |
| 2018/0360276 | A1 | 12/2018 | Yang et al. | |

FOREIGN PATENT DOCUMENTS

| | | | |
|---|---|---|---|
| CN | 102058336 | A | 5/2011 |
| CN | 201730168630.4 | | 2/2018 |
| EP | 0455431 | A1 | 11/1991 |
| EP | 0493865 | A1 | 7/1992 |
| EP | 2135538 | A1 | 12/2009 |
| EP | 2322068 | A2 | 5/2011 |
| EP | 2546523 | A2 | 1/2013 |
| EP | 2738387 | A1 | 6/2014 |
| JP | H07-23876 | | 1/1995 |
| JP | D1117308 | | 6/2001 |
| JP | D1266683 | | 2/2006 |
| JP | 2013-133754 | A | 7/2013 |
| KR | 3002845520000 | | 11/2001 |
| WO | WO 2008/095187 | | 8/2008 |
| WO | WO 2008/103300 | A2 | 8/2008 |
| WO | WO 2012/122056 | | 9/2012 |
| WO | WO 2012/154642 | A1 | 11/2012 |
| WO | WO 2013/119642 | A1 | 8/2013 |
| WO | WO 2013/119874 | A1 | 8/2013 |

OTHER PUBLICATIONS

Manring et al., "The Theoretical Flow Ripple of an External Gear Pump," Transactions of the ASME, vol. 125, Sep. 2003, pp. 396-404.

The Sharper Image Soap Genie SI335, Mar. 2006, in 8 pages.

U.S. Appl. No. 29/597,635, filed Mar. 17, 2017, Yang et al.

Simplehuman® Rechargeable Sensor Soap Dispenser, Item No. 201881, https://www.sharperimage.com/si/view/product/Rechargeable-Sensor-Soap-Dispenser/201881?trail, published on Sep. 3, 2013, in 3 pages.

Simplehuman® Rechargeable Sensor Soap Dispenser, Item No. 201881, https://www.sharperimage.com/si/view/product/Rechargeable-Sensor-Soap-Dispenser/201881?trail, Sep. 3, 2013, 3 pages.

Extended Search Report in corresponding European Patent Application No. 18161558.4, dated Oct. 24, 2018, 11 pages.

Office Action in corresponding European Patent Application No. 18161558.4, dated Jun. 12, 2019, 4 pages.

Summons to attend oral proceedings in corresponding European Patent Application No. 18161558.4, dated Mar. 2, 2020, in 6 pages.

* cited by examiner

SOAP PUMP

CROSS-REFERENCE

This application claims the priority benefit under 35 U.S.C. § 119 of U.S. Provisional Application No. 62/472,855, filed Mar. 17, 2017, the entirety of which is hereby incorporated by reference. This application also incorporates by reference the entirety of U.S. Design patent application No. 29/597,635, filed Mar. 17, 2017.

BACKGROUND

Field

The present disclosure relates to liquid dispensers, such as liquid soap dispensers.

Description of Certain Related Art

Users of modern public washroom facilities increasingly desire that each of the fixtures in the washroom operate automatically without being touched by the user's hand. This is important in view of increased user awareness of the degree to which germs and bacteria may be transmitted from one person to another in a public washroom environment. Today, it is not uncommon to find public washrooms with automatic, hands-free operated toilet and urinal units, hand washing faucets, soap dispensers, hand dryers, and door opening mechanisms. This automation allows the user to avoid touching any of the fixtures in the facility, and therefore lessens the opportunity for the transmission of disease-carrying germs or bacteria resulting from manual contact with the fixtures in the washroom.

SUMMARY OF CERTAIN FEATURES

Various soap dispensers are disclosed. The soap dispenser can include a housing, a reservoir configured to store a liquid (e.g., liquid soap), a pump, a fluid passageway, and a nozzle. The pump can encourage the liquid to flow along the fluid passageway from the reservoir to the nozzle for discharge to a user. In several embodiments, the pump can be a peristaltic pump. In some embodiments, this allows the pump to be located near a top of the dispenser and/or near the nozzle. For example, the relatively high differential pressure of the peristaltic pump (compared to, for example, certain gear pumps) can enable the pump to pull the liquid soap upward against the flow of gravity on the upstream side of the pump. Having the pump near the top of the dispenser can put the pump in a location that is convenient for manufacturing or service, that is protected, and/or that enables a rapid dispensation of soap. In some embodiments, the pump can facilitate an accurate dispensation volume. For example, the pump can drive discrete and known volumes of the liquid soap. In some embodiments, such discrete and known volumes of the liquid soap are the volumes between occlusions in the peristaltic pump. Certain embodiments of the dispenser are configured to vary the dispensation volume, such as based on the sensed distance to a detected object. In certain implementations, the pump being a peristaltic pump, and being positioned near the top of the dispenser, and being configured to drive discrete volumes of a known amount enables precise control of the dispensation volume.

According to some embodiments, a liquid dispenser comprises a housing; a reservoir configured to store a liquid; a flexible tube disposed in the housing, a pump disposed in the housing; and a motor disposed in the housing. Some embodiments have a first sensor configured to generate a signal based on a distance between an object and the first sensor; and an electronic processor configured to receive the signal from the first sensor. In some embodiments, the processor is configured to determine a dispensation volume of the liquid. The dispensation volume can vary as a function of the distance between the object and the first sensor, the processor further configured to control the motor to dispense approximately the dispensation volume of the liquid. The flexible tube can include an inlet and an outlet. The pump can include a rotor including a plurality of rollers, wherein the rotor has a rotor rotational axis, wherein each of the plurality of rollers has a roller rotational axis, and wherein the plurality of rollers is configured to rotate about the rotor rotational axis and the roller rotational axis. The motor can be configured to drive the pump configured to cause the liquid to move through the flexible tube.

In some embodiments, the liquid includes liquid soap. In some embodiments, the pump is positioned closer to a top of the housing than a bottom of the housing. In some embodiments, the dispenser further comprises a nozzle configured to allow the liquid to be dispensed. In some embodiments, the pump is positioned adjacent a plane extending generally perpendicular to a vertical axis of the nozzle.

In some embodiments, a length of the flexible tube that is downstream of the pump is less than a length of the flexible tube that is upstream of the pump. In some embodiments, when the reservoir is substantially full of liquid, a volume of the liquid in the flexible tube downstream of the pump is less than a volume of the liquid in the flexible tube upstream of the pump.

In some embodiments, the plurality of rollers include at least three rollers. In some embodiments, each of the plurality of rollers is configured to sequentially contact the flexible tube such that each of the plurality of rollers compresses a portion of the flexible tube that is in contact with the roller. In some embodiments, the flexible tube extends from the reservoir to the nozzle and passes through the pump. In some embodiments, the pump is a peristaltic pump. In some embodiments, the electronic processor is configured to send the signal to the motor by generating a first signal to dispense a first volume of fluid when the object is within a first distance from the first sensor, and generating a second signal to dispense a second volume of fluid when the object is within a second distance from the first sensor, wherein the first volume is smaller than the second volume and the first distance is less than the second distance.

According to some embodiments, a dispenser comprises: a housing; a reservoir configured to store a liquid; and a flexible tube connected to the reservoir. Some embodiments include a pump comprising: a plurality of rollers, wherein each of the plurality of rollers is configured to contact the flexible tube such that each of the plurality of rollers compresses a portion of the flexible tube that is in contact with the roller, and wherein the pump is disposed within the housing such that a length of the flexible tube that is positioned downstream of the pump is shorter than a length of the flexible tube that is positioned upstream of the pump. A first sensor can be configured to generate a signal based on a distance between an object and the first sensor. An electronic processor can be configured to receive the signal from the first sensor and to determine a dispensation volume of the liquid. The dispensation volume can vary as a function of the distance between the object and the first sensor. The processor can be configured to control the motor to dispense approximately the dispensation volume of the liquid.

In some embodiments, the dispenser comprises a motor disposed in the housing, wherein the motor is configured to drive the pump configured to cause a liquid to move through the flexible tube. In some embodiments, the flexible tube is configured to create a seal between the liquid from the pump such that the liquid does not contact the pump. In some embodiments, the liquid includes liquid soap. In some embodiments, the reservoir is in an empty state when an insufficient amount of liquid is disposed within the reservoir and the reservoir is in a full state when a sufficient amount of liquid is disposed within the reservoir, and wherein when the reservoir transitions from an empty state to a full state, at least a portion of the liquid moves into an opening in the flexible tube.

In some embodiments, the number of revolutions of each of the plurality of rollers about a rotational axis corresponds to a volume of liquid that is dispensed. In some embodiments, the portion of the flexible tube that is in contact with the roller remains compressed when no liquid is dispensed. In some embodiments, the electronic processor is configured to send the signal to the motor by generating a first signal to dispense a first volume of fluid when the object is within a first distance from the first sensor, and generating a second signal to dispense a second volume of fluid when the object is within a second distance from the first sensor, wherein the first volume is smaller than the second volume and the first distance is less than the second distance.

For purposes of summarizing the disclosure, certain aspects, advantages and features have been described. Not necessarily any or all such advantages will be achieved in accordance with any or all of the particular embodiments disclosed herein. Neither this Summary, nor the following Detailed Description, nor the accompanying figures are intended to be limiting.

BRIEF DESCRIPTION OF THE DRAWINGS

Certain features, aspects, and advantages of the subject matter disclosed herein are described below with reference to the drawings, which are intended to illustrate and not to limit the scope of the disclosure. Various features of different disclosed embodiments can be combined to form additional embodiments, which are part of this disclosure. No structures, features, steps, or processes are essential or critical; any can be omitted in certain embodiments. The drawings comprise the following figures.

DETAILED DESCRIPTION OF CERTAIN EMBODIMENTS

A variety of soap dispensers are described below to illustrate various examples that may be employed to achieve one or more desired improvements. These examples are only illustrative and not intended in any way to restrict the general inventions presented and the various aspects and features of these inventions. The phraseology and terminology used herein is for the purpose of description and should not be regarded as limiting. No features, structure, or step disclosed herein is essential or indispensable.

FIG. 1

Figure 1:
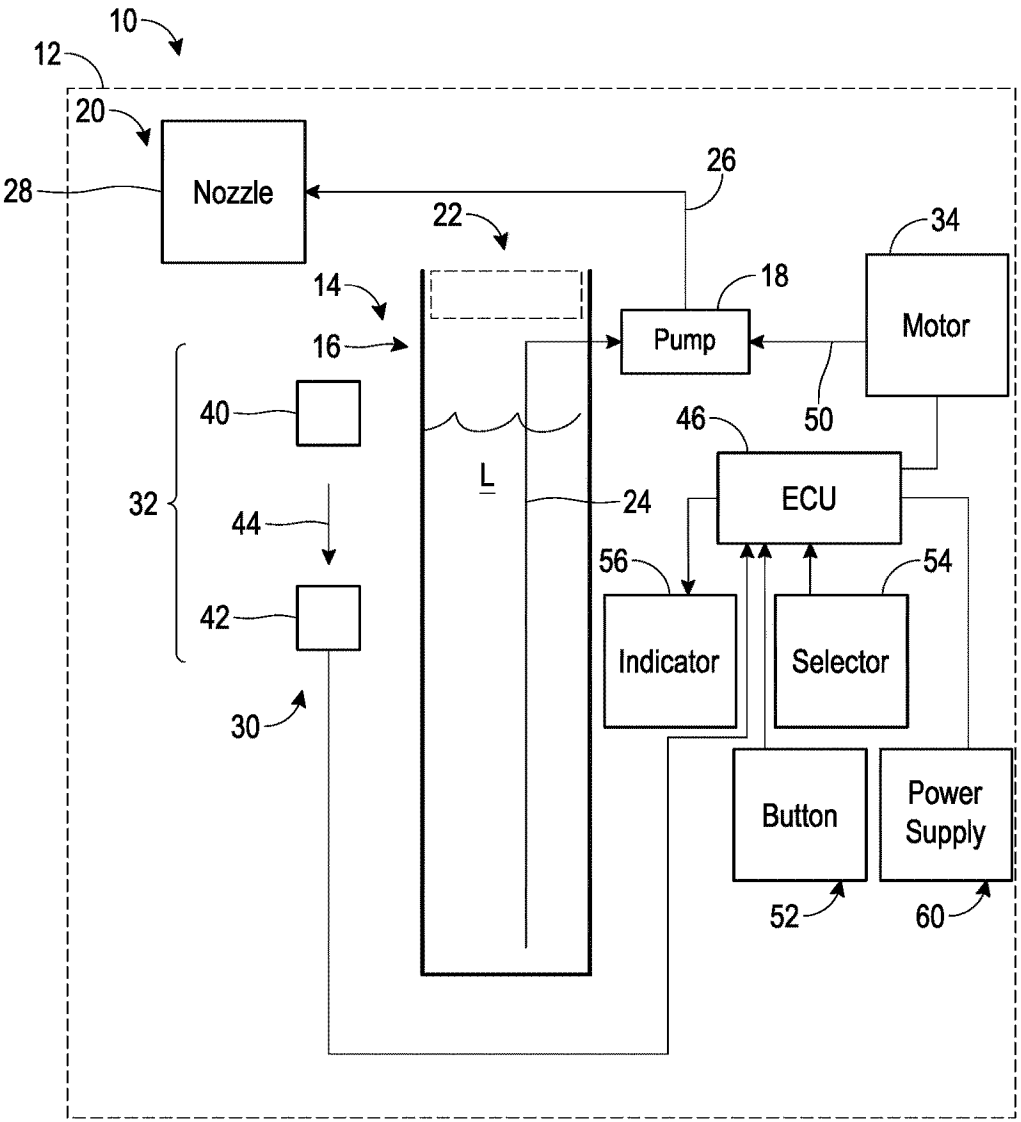
FIG. 1 schematically illustrates an automatic liquid soap dispenser.

FIG. 1 schematically illustrates a soap dispenser 10. The dispenser 10 can include a housing 12, which can take any shape. In some embodiments, the housing 12 can at least partially contain a liquid handling system 14. The liquid handling system 14 can include a reservoir 16, a pump 18, and a discharge assembly 20.

The reservoir 16 can be any type of container. In the illustrated embodiment, the reservoir 16 can be configured to contain a volume of liquid soap, such as liquid soap for hand washing. In some embodiments, the reservoir 16 can include a lid 22 configured to form a seal at the top of the reservoir 16 for maintaining the liquid soap L within the reservoir 16. In some embodiments, the lid 22 can include an air vent (not shown), which can allow air to enter the reservoir 16 as the level of liquid soap L falls within the reservoir 16. In some embodiments, the reservoir 16 is connected to the pump 18 by a tube 24. Any type or diameter of tube 24 can be used. In some embodiments, the tube 24 can comprise plastic, metal, and/or rubber, among other materials.

The tube 24 can be at least partially positioned within the reservoir 16. In some embodiments, the tube 24 can be connected with the reservoir 16 through the outlet 24 at an upper end and/or a mid-section of the reservoir 16.

In some embodiments, the pump 18 can be disposed above the outlet 24 of the reservoir 16. In some embodiments, the pump 18 is aligned with the outlet 24 of the reservoir 16. For example, the pump 18 can be positioned adjacent and/or at least partially adjacent the outlet 24 of the reservoir 16. In some embodiments, the pump 18 is automatically primped due to a compression force caused by the pump 18 on the tube 24, thereby drawing liquid soap L into the pump 18 from the reservoir 16. The pump 18 can be connected to the discharge system 20 with a conduit 26. Any type or diameter of conduit can be used.

The discharge assembly 20 can include a discharge nozzle 28, such as a flap-type nozzle as described in further detail below. The size and configuration of the discharge nozzle 28 can be determined to provide the appropriate flow rate and/or resistance against flow of liquid soap L from the pump 18. In some embodiments, the nozzle 28 can be disposed at a location spaced from the lower portion of the housing 12 so as to make it more convenient for a user to place their hand or other body part under the nozzle 28. For example, the nozzle 28 can be positioned near and/or adjacent a top of the housing 12.

The dispenser 10 can include a power supply 60. In some embodiments, the power supply 60 can be a battery. In certain embodiments, the power supply 60 includes electronics for accepting AC or DC power. In some implementations, the power supply 60 can be configured to interface with a standard domestic electrical supply (e.g., 120 volt alternating current). The power supply 60 is described in more detail below.

In certain embodiments, the dispenser 10 has a pump actuation system 30, which in turn includes a sensor device 32 and a light receiving portion 42. In some embodiments, a beam of light 44 can be emitted from the light emitting portion 40 and received by the light receiving portion 42.

The sensor 32 can be configured to emit a trigger signal when the light beam 44 is blocked. For example, if the sensor 32 is activated, and the light emitting portion 40 is activated, but the light receiving portion 42 does not receive the light emitted from the light emitting portion 40, then the sensor 32 can emit a trigger signal. This trigger signal can be used for controlling operation of the motor or an actuator 34, described in greater detail below. This type of sensor can provide further advantages.

For example, because in some embodiments the sensor 32 can be an interrupt-type sensor, it can be triggered when a body is disposed in the path of the beam of light 44. The sensor 32 is not or need not be triggered by movement of a body in the vicinity of the beam 44. Rather, in some embodiments, the sensor 32 can be triggered only if the light beam 44 is interrupted. To provide further or alternative prevention of unintentional triggering of the sensor 32, the sensor 32, including the light emitting portion 40 and the light receiving portion 42, can be recessed in the housing 12.

In certain implementations, the sensor 32 only requires enough power to generate the low power beam of light 44, which may or may not be visible to the human eye, and to power the light receiving portion 42. These types of sensors require far less power than infrared or motion-type sensors. In some embodiments, the sensor 32 can be operated in a pulsating mode. For example, the light emitting portion 40 can be powered on and off in a cycle such as, for example, for short bursts lasting for any desired period of time (e.g., less than or equal to about 0.01 second, less than or equal to about 0.1 second, or less than or equal to about 1 second) at any desired frequency (e.g., once per half second, once per second, once per ten seconds). These different time characteristics can be referred to as an activation period or frequency, which corresponds to the periodic activation of the sensor 32. Thus, an activation frequency of four times per second would be equivalent to an activation period of once per quarter second.

The other aspect of this characteristic can be referred to as an activation duration. Thus, if the sensor 32 is activated for 50 microseconds, 50 microseconds is the activation duration time period. Cycling can greatly reduce the power demand for powering the sensor 32. In operation, cycling does not degrade performance in some embodiments because the user generally maintains his or her body parts or other appendage or device in the path of the light beam 44 long enough for a detection signal to be generated and to trigger the sensor 32.

The sensor 32 can be connected to a circuit board, an integrated circuit, or other device for triggering the actuator 34. In some embodiments, the sensor 32 can be connected to an electronic control unit ("ECU") 46. The ECU 46 can include one or a plurality of circuit boards, which can provide hard wired feedback control circuits, a processor and memory devices for storing and performing control routines, or any other type of controller. In some embodiments, the ECU 46 can include an H-bridge transistor/MOSFET hardware configuration which allows for bidirectional drive of an electric motor, and a microcontroller such as Model No. PIC16F685 commercially available from the Microchip Technology Inc., and/or other devices.

The actuator 34 can be any type of actuator. For example, the actuator 34 can be an AC or DC electric motor, stepper motor, server motor, solenoid, stepper solenoid, or any other type of actuator. In some embodiments, the actuator 34 can be connected to the pump 18 with a transmitter device 50. For example, the transmitter device 50 can include any type of gear train or any type of flexible transmitter assembly.

The dispenser 10 can include a user input device 52. The user input device 52 can be any type of device allowing a user to input a command into the ECU 46. In some embodiments, the input device 52 can be in the form of a button configured to allow a user to depress the button so as to transmit a command to the ECU 46. For example, the ECU 46 can be configured to actuate the actuator 34 to drive the pump 18 any time the input device 52 can be actuated by a user. The ECU 46 can be configured to provide other functions upon the activation of the input device 52, described in greater detail below.

The dispenser 10 can include a selector device 54. The selector device 54 can be any type of configuration allowing the user to input a proportional command to the ECU 46. For example, the selector device 54 can have at least two positions, such as a first position and a second position. The position of the selector device 54 can be used to control an aspect of the operation of the dispenser 10.

For example, the selector device 54 can be used as a selector for allowing a user to select different amounts of liquid soap L to be dispensed from the nozzle 28 during each dispensation cycle. When the selector device 54 is in a first position, the ECU 46 can operate the actuator 34 to drive the pump 18 to dispense a predetermined amount of liquid soap L from the nozzle 28, each time the sensor 32 is triggered. When the selector device 54 is in the second position, the ECU 46 can actuate the actuator 34 to dispense a larger amount of liquid soap L from the nozzle 28.

In some embodiments, the selector device 54 can provide a virtually continuous range of output values to the ECU 46, or a larger number of steps, corresponding to different volumes of liquid soap L to be dispensed each dispensation cycle performed by the ECU 46. Although the positions of the selector device 54 may correspond to different volumes of liquid soap L, the ECU 46 can correlate the different positions of the selector device 54 to different duty cycle characteristics or durations of operation of the actuator 34, thereby at times discharging differing or slightly differing volumes of liquid soap L from the nozzle 28.

The dispenser 10 can include an indicator device 56 configured to issue a visual, aural, or other type of indication to a user of the dispenser 10. For example, in some embodiments, the indicator 56 can include a light and/or an audible tone perceptible to the operator of the dispenser 10. In some embodiments, the ECU 46 can be configured to actuate the indicator 56 to emit a light and/or a tone after a predetermined time period has elapsed after the actuator 34 has been driven to dispense a predetermined amount of liquid soap L from the nozzle 28. The indicator device 56 can provide a reminder to a user of the dispenser 10 to continue to wash their hands until the indicator 56 has been activated. This predetermined time period can be at least about 20 seconds, although other amounts of time can be used. The indicator 56 can be used for other purposes as well.

In some embodiments, the indicator 56 can be activated for a predetermined time after the pump has completed a pumping cycle. For example, the ECU 46 can be configured to activate the indicator 56 for 20 seconds after the pump 18 has been operated to discharge an amount of soap from the nozzle 28. The indicator 56 can be activated at the appropriate time for advising users as to how long they should wash their hands.

In some embodiments, the indicator 56 can be a Light Emitting Diode (LED) type light, and can be powered by the ECU 46 to blink throughout the predetermined time period. Thus, a user can use the length of time during which the indicator 56 blinks as an indication as to how long the user should continue to wash their hands with the soap disposed from the nozzle 28. Other types of indicators and predetermined time periods can be used.

In operation, the ECU 46 can activate the sensor 32, continuously or periodically, to detect the presence of an object between the light emitting portion 40 and the light receiving portion 42 thereof. When an object blocks the light beam 44, the ECU 46 determines that a dispensing cycle should begin. The ECU 46 can then actuate the actuator 34 to drive the pump 18 to thereby dispense liquid soap L from the nozzle 28.

As noted above, in some embodiments, the ECU 46 can vary the amount of liquid soap L dispensed from the nozzle 28 for each dispensation cycle, depending on a position of the selector 54. Thus, for example, the dispenser 10 can be configured to discharge a first volume of liquid soap L from the nozzle 28 when the selector 54 is in a first position, and to discharge a second different amount of liquid soap L when the selector 54 is in a second position. In some embodiments, the ECU 46 can vary the amount of liquid soap L dispensed based on an input, such as the distance from a detected object to the sensor 32.

As noted above, the indicator 56 can be activated, by the ECU 46, after a predetermined amount of time has elapsed after each dispensation cycle. The ECU 46 can be configured to cancel or prevent the indicator 56 from being activated if the button 52 has been actuated in accordance with a predetermined pattern. For example, the ECU 46 can be configured to cancel the activation of the indicator 56 if the button 52 has been pressed twice quickly. However, any pattern of operation of the button 52 can be used as the command for canceling the indicator 56. The dispenser 10 can include other input devices for allowing a user to cancel the indicator 56.

In some embodiments, the ECU 46 can be configured to continuously operate the actuator 34 or to activate the actuator 34 for a maximum predetermined time when the button 52 is depressed. This can allow an operator of the dispenser 10 to manually operate the dispenser to continuously discharge or discharge larger amounts of liquid soap L when desired. For example, if a user of the dispenser 10 wishes to fill a sink full of soapy water for washing dishes, the user can simply push the button 52 and dispense a larger amount of soap than would normally be used for washing one's hands, such as at least about 3 milliliters or at least about 4 milliliters.

FIGS. 2-13

FIGS. 2-13 illustrate another embodiment of a dispenser 100. The dispenser 100 can be similar or identical to the dispenser 10 discussed above in many respects. Accordingly, numerals used to identify features of the dispenser 100 are incremented by a factor of one hundred to identify certain similar features of the dispenser 10. For example, the dispenser 100 can include a housing 112 (which can include any of the features of the housing 12) and a liquid handling system 114 (which can include can include any of the features of the housing 14). The liquid handling system 114 can include a reservoir 116, a pump 118, and a discharge assembly 120 (which can respectively include any of the features of the reservoir 16, pump 18, and discharge assembly 20). The dispenser 100 can include any one, or any combination, of the features of the dispenser 10.

Figure 2:
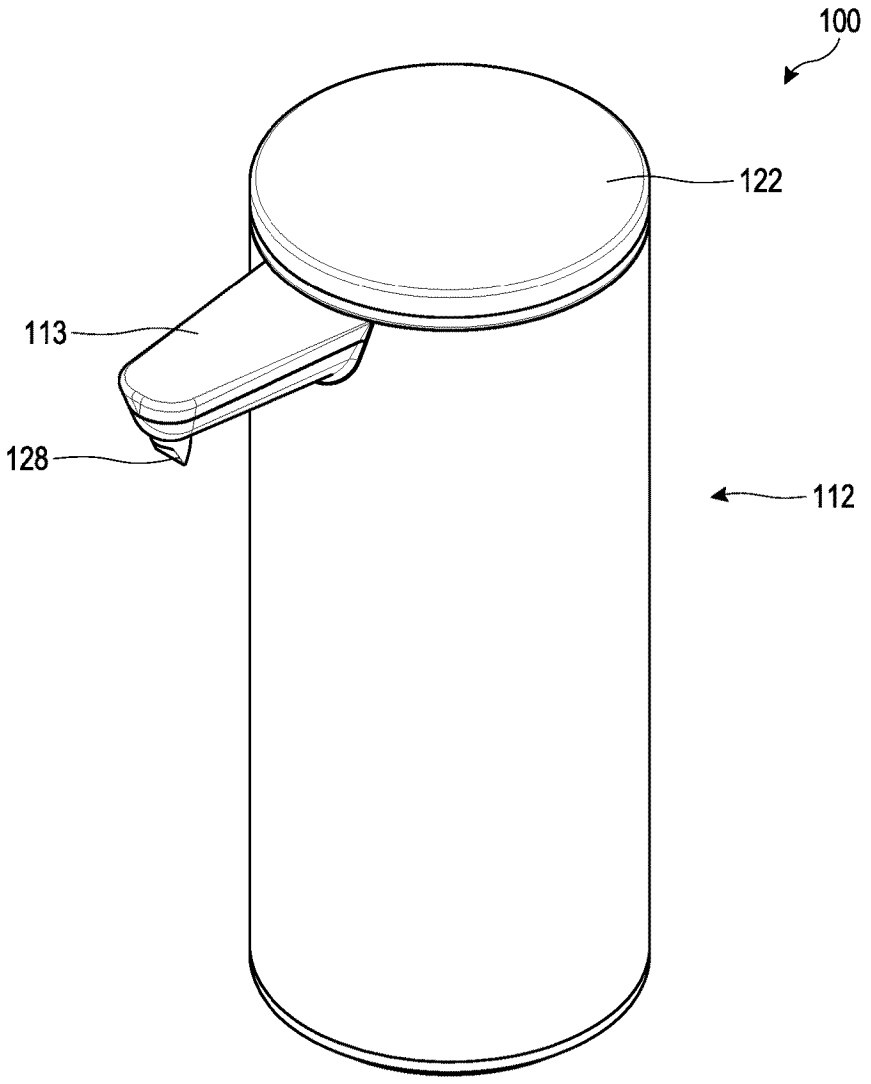
FIG. 2 illustrates a top, front, and side perspective view of an embodiment of a liquid soap dispenser.
Figure 3:
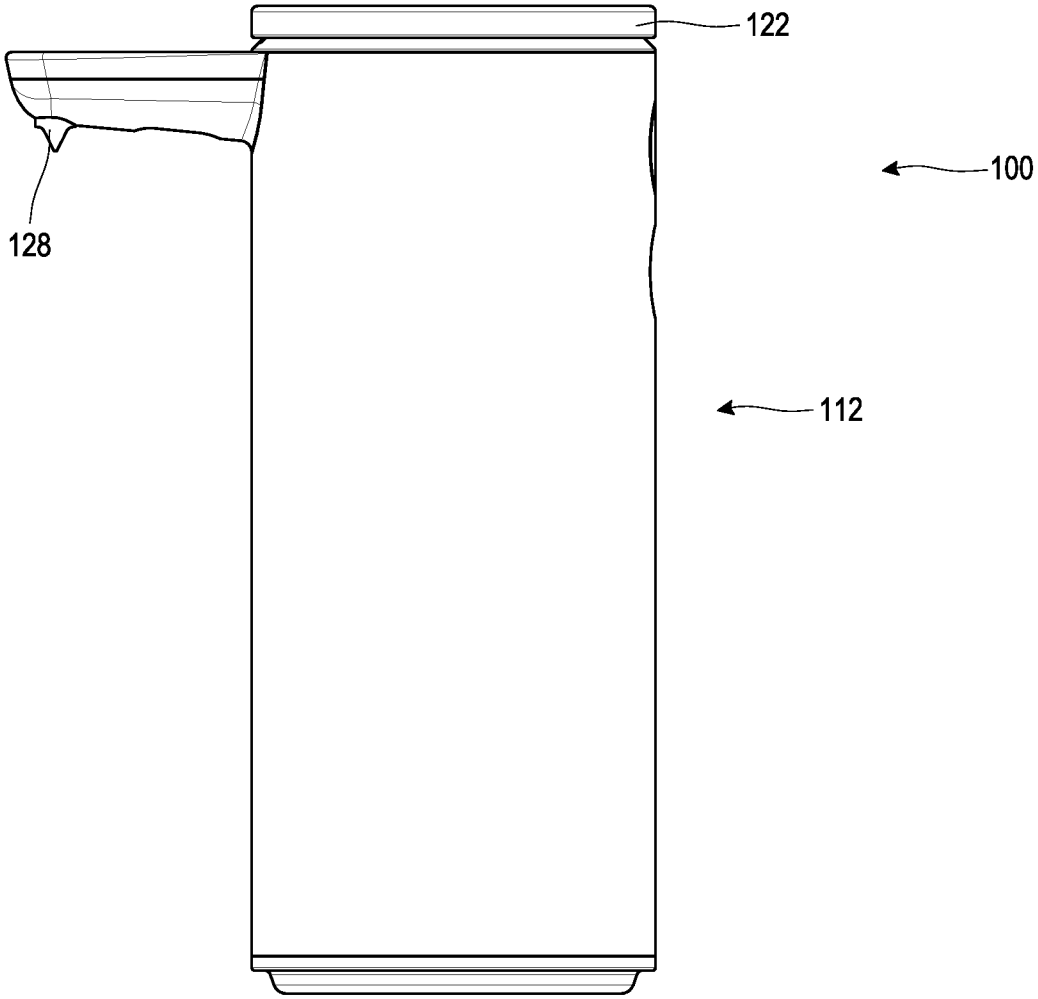
FIG. 3 illustrates a side view of the liquid soap dispenser of FIG. 2.
Figure 4:
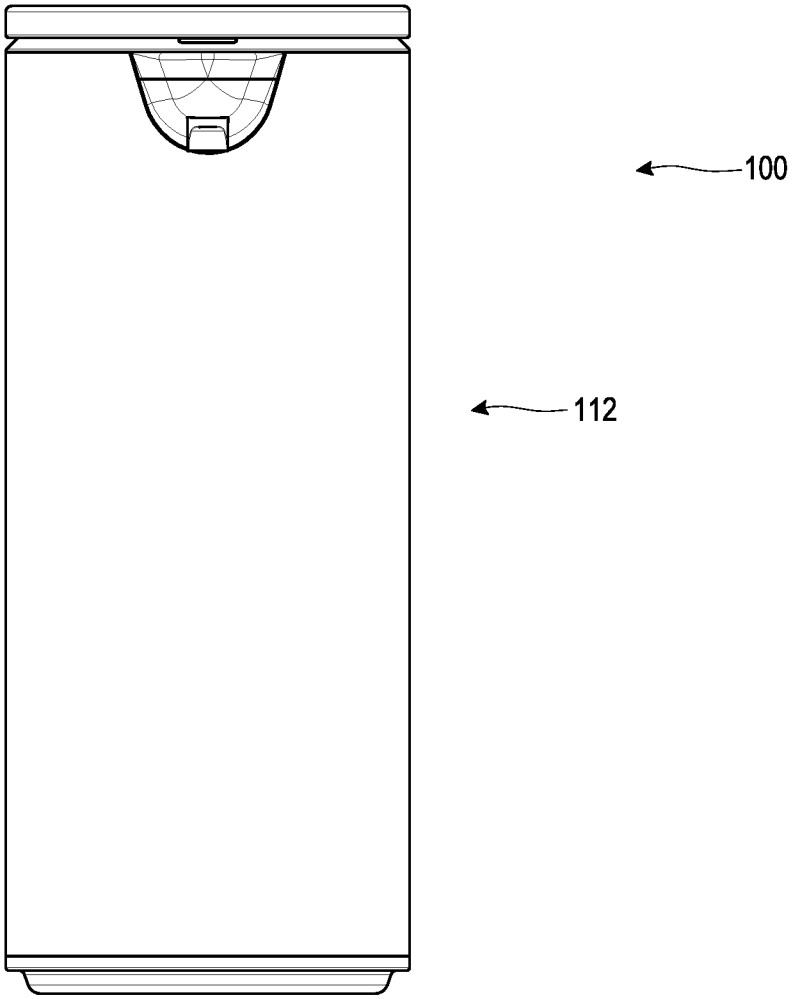
FIG. 4 illustrates a front view of the liquid soap dispenser of FIG. 2.

As shown in at least FIGS. 2-4, the lower portion of the dispenser 100 can be designed to support the housing 112 on a generally flat surface, such as those normally found on a countertop in a bathroom or a kitchen. Further, some embodiments of the dispenser 100 are movable. For example, the dispenser 100 can be readily relocated from one position to another position on a countertop. In some implementations, the dispenser 100 is not attached, embedded, or otherwise joined with a surface that supports the dispenser 100. For example, certain implementations of the dispenser 100 are not mounted to, or recessed in, a countertop or wall.

Figure 5:
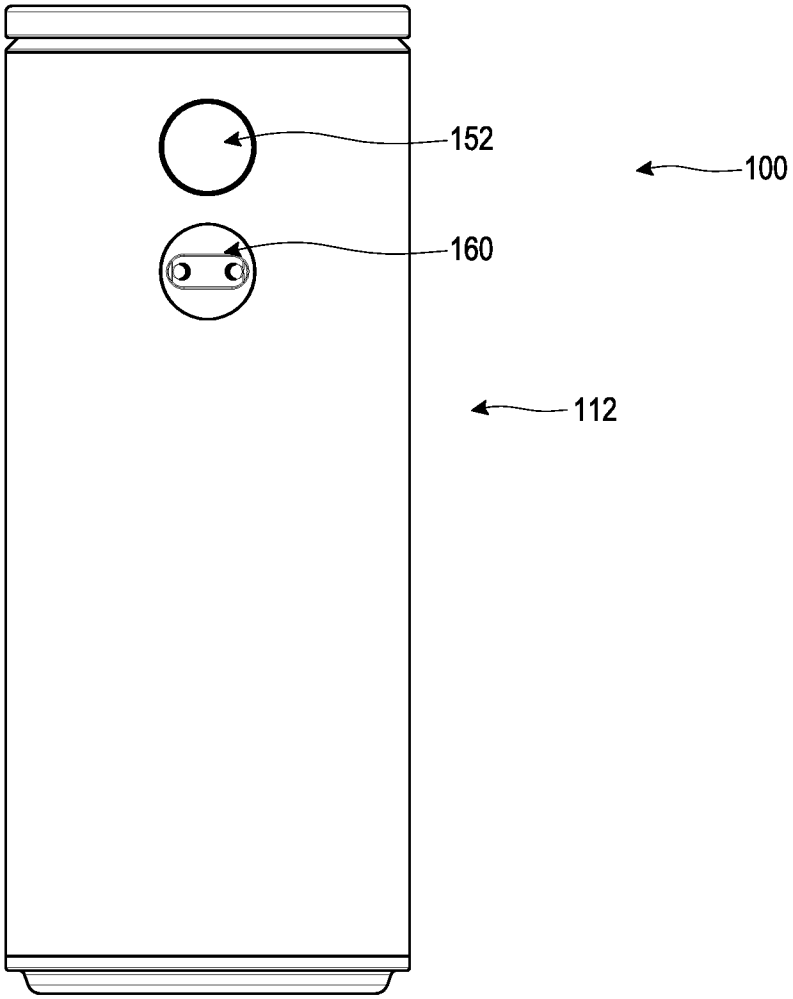
FIG. 5 illustrates a rear view of the liquid soap dispenser of FIG. 2.

As shown in FIG. 5, the dispenser 100 can include a user input device 152, such as a button, switch, or otherwise. The user input device 152 can be configured to act as a power actuator that enables a user to turn the soap dispenser on and off. The user input device 152 can be configured to be depressed by the touch of a user. In some embodiments, the user input device 152 includes a sensor such that the user input device 152 does not need to be depressed to turn the soap dispenser on and off. In several embodiments, the user input device 152 can be actuated to provide an input to the dispenser 100 (e.g., to the ECU). For example, in some variants, the user input device 152 can be actuated for an extended period (e.g., at least about three seconds) to indicate to the dispenser 100 to dispense a large amount of soap, such as an amount sufficient for washing a kitchen sink full of dishes. In some variants, the dispenser 100 continuously dispenses soap while the input device 152 is actuated.

In some embodiments, the dispenser 100 includes a power supply 160, such as a battery, capacitor, or other power storage device. In some variants, at least a portion of the power supply 160 is located in the liquid handling system 114. For example, in certain embodiments (e.g., in some embodiments in which the reservoir 116 is a disposable item), a battery or other power storage device can be located in the liquid handling system 114. In some embodiments, the power supply 160 is positioned within the housing 112. In some embodiments, the power supply 160 is positioned adjacent the lid 122. In some embodiments, the power supply 160 is positioned adjacent a bottom of the housing 112. In some embodiments, the power supply 160 is positioned adjacent a side wall of the housing 112. For example, the power supply 160 can be positioned adjacent the user input device 152. In some embodiments, the power supply 160 and/or the user input device 152 are positioned at a rear of the housing 112.

In some embodiments, the power supply 160 is configured to connect with an external power source for recharging, such as with a port or cord to connect with a universal serial bus (USB) cable and/or domestic power. In some embodiments, the power supply 160 is configured to engage with the cord. For example, the power supply 160 can include an engaging element (e.g., a magnet) that is configured to engage (e.g., magnetically couple) with a corresponding engaging element (e.g., another magnet) of the cord, which can aid in locating and/or securing the cord on the power supply 160. For example, some embodiments are configured such that, when the engaging elements of the power supply 160 are engaged with the engaging elements of the cord, a contact of the power supply 160 is automatically electrically connected with a contact of the cord, thereby allowing electrical power to be provided from the cord to the power supply 160.

In some implementations, the power supply 160 is configured to engage with a head portion of the cord in multiple orientations and/or to enable a user to flip the head portion around yet still be able to engage with the power supply 160. In some implementations, the power supply 160 and/or the head portion are configured to facilitate engagement. For example, one of the power supply 160 and the head portion can include a projection and the other of the power supply 160 and the head portion can include a recess configured to receive the projection. In some embodiments, the head portion of the cord has a generally cylindrical shape.

In various embodiments, the power supply 160 is sealed, such as with a gasket, adhesive, welds, or otherwise. This can reduce the chance of water intrusion into the power supply 160 and/or the liquid handling system 114. Certain implementations are configured to inhibit or prevent water from entering the power supply 160 and/or passing between the power supply 160 and a lid 122. In some embodiments, the user input device 152 comprises a material that is electrically conductive and resistant to corrosion in the presence of freshwater, such as stainless steel, copper, aluminum, or otherwise.

Figure 6:
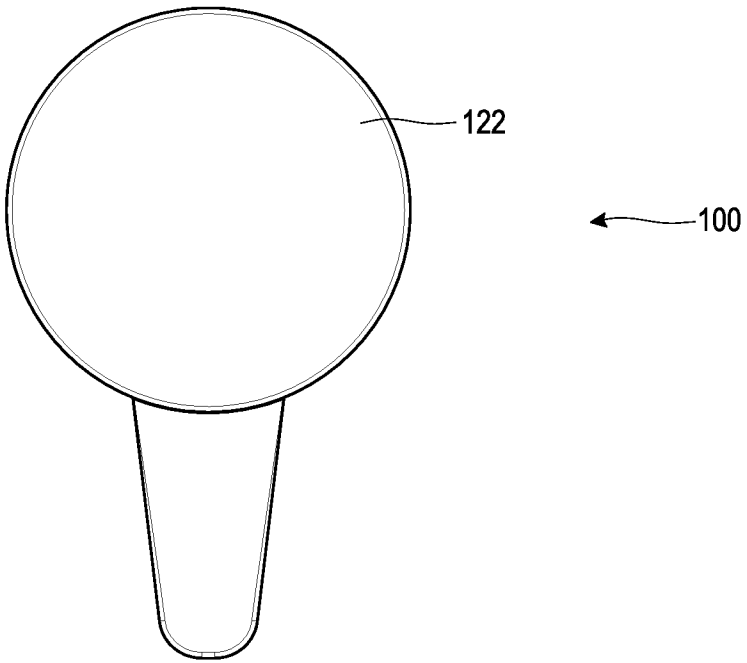
FIG. 6 illustrates a top view of the liquid soap dispenser of FIG. 2.

In some embodiments, the liquid handling system 114 is configured to avoid accumulating water in and/or near the power supply 160. This can reduce the chance of corrosion of the power supply 160 and/or other portions of the liquid handling system 114. As previously mentioned, the power supply 160 can be accessed via a top of the liquid handling system 114 and/or the side of the liquid handling system 114. In some embodiments, the user input device 152 is positioned in a bulge of the side of the housing 112, such as a hemispherical or frustoconical bulge. In various implementations, the user input device 152 is not positioned in a recess. In some embodiments, such as is shown in FIG. 6, the lid 122 can be generally planar and/or flat. Further details regarding the power supply 160 and other features can be found in U.S. Patent Application Publication No. 2016/0256016, filed Mar. 3, 2016, the entirety of which is hereby incorporated by reference herein.

Figure 7:
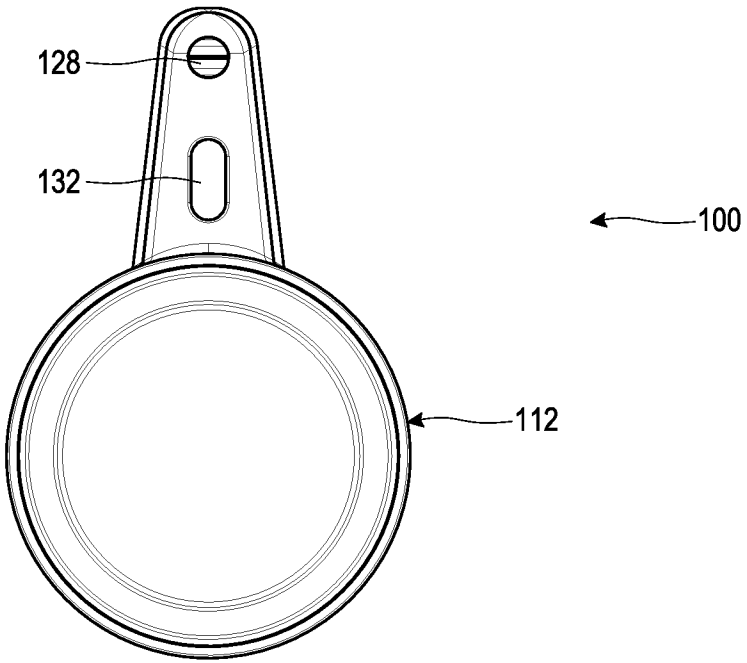
FIG. 7 illustrates a bottom view of the liquid soap dispenser of FIG. 2.

As illustrated in FIG. 7, the dispenser 100 can include a sensor 132. The sensor 132 can be activated continuously or periodically. In some embodiments, the sensor 132 is configured to detect the presence of an object between the light emitting portion and the light receiving portion thereof. As discussed above, when an object blocks the light beam, the dispenser 100 can determine that a dispensing cycle should begin, such as actuating the user input device 152 to drive the pump 118 to thereby dispense liquid soap L from a nozzle 128. In some embodiments, the sensor 132 transmits a signal and detects reflections of the signal, such as reflected infrared signals of a person's hand.

Figure 8:
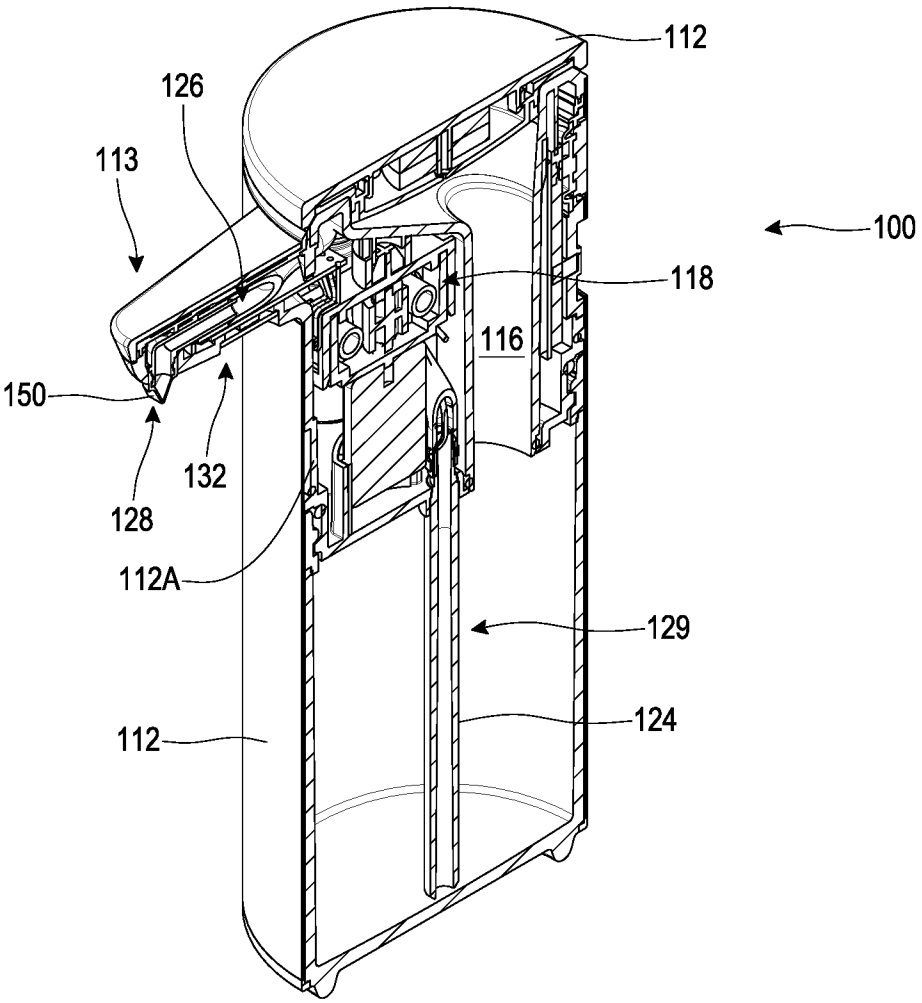
FIG. 8 illustrates a side cross-sectional view of the liquid soap dispenser of FIG. 2.

As shown in FIG. 8, certain embodiments include a casing 112A, such as a rigid plastic or metal shell. In some embodiments, the casing 112A is positioned entirely within the housing 112. In some embodiments, the casing 112A is positioned at least partially within the housing 112. In some embodiments, the casing 112A includes an upper portion and lower portion. The upper and lower portions can be joined together, such as with fasteners, adhesive, and/or welding (e.g., ultrasonic welding). The casing 112A can be configured to protect and/or retain some or all of the components of the liquid handling system 114, such as the motor 134 and/or the pump 118. In some embodiments, the casing 112A includes one or more seals (e.g., rubber gaskets) that are configured to engage with the housing 112 and/or to inhibit water from passing between the casing 112A and the housing 112.

As mentioned above, in some implementations, the fluid handling unit 104 includes a lid 122. The lid 122 can engage with the casing 112A and/or the housing 112 to seal and/or protect components of the liquid handling system 114, such as the motor 134 and/or the pump 118, among other components described herein. For example, the engagement between the lid 122 and the casing 112A can inhibit water and dirt from entering the liquid handling system 114. In some embodiments, the lid 122 engages a seal (e.g., a rubber gasket) to provide a generally liquid tight seal. In certain embodiments, the lid 122 is configured to shed water. For example, the lid 122 can be pitched, such as being higher at the radial middle than at the radial edge. In some embodiments, the lid 122 is substantially flat.

The reservoir 116 can be disposed within the housing 112. The pump 118 can be disposed above at least a portion of the reservoir 116, as described in more detail below. As discussed above, the pump 118 can be connected to the reservoir 116 by a tube 124. For example, soap can travel from the reservoir 116 through the tube 124 and passes through the pump 118. Any type or diameter of tube 124 can be used. In some embodiments, the tube 124 can include plastic, metal, and/or rubber, among other materials.

The tube 124 can be at least partially positioned within the reservoir 116. For example, a bottom end of the tube 124 can be positioned at a lower end of the reservoir 116. In some embodiments, the bottom end of the tube 124 is positioned at a lower ½, ⅓, ¼, and/or ⅛ of the reservoir 116 such that the bottom end of the tube 124 is spaced upwardly from the bottom of the reservoir 116. In some embodiments, the tube 124 is raised from the bottom of the reservoir 116, but is positioned closer to the bottom of the reservoir 116 than the top of the reservoir 116.

The dispenser 100 can have a passageway 129 for soap to travel from the reservoir 116 to the nozzle 128. The passageway 129 can include the tube 124, which can be a portion of the passageway 129 that is upstream of the pump 118. The passageway 129 can include a conduit 126, which can be a portion of the passageway 129 that is downstream of the pump 118.

As described in more detail below, the pump 118 can displace fluid. For example, the pump 118 can be configured to draw soap from the reservoir 116 into the tube 124 and/or to push the soap through the conduit 126 to be discharged out of the nozzle 128. In some embodiments, the conduit 126 is connected to the tube 124 at one end and to the nozzle 128 at the other end. In some embodiments, the conduit 126 refers to a portion of the tube 124 that extends between the pump 118 and the nozzle 128. In some embodiments, the conduit 126 is integrally formed with the tube 124. In some embodiments, the conduit 126 is separately formed from the tube 124 such that the conduit 126 is connected to the tube 124 at one end of the pump 118. In some embodiments, the conduit 126 and the tube 124 are sealingly engaged to inhibit or prevent outside air and/or fluid from entering the tube 124 and/or the conduit 126 or contaminating the fluid traveling through the tube 124 and/or the conduit 126.

In certain variants, the pump 118 can encourage fluid to flow through the passageway 129, so that the fluid can be discharged from the nozzle 128. As described in more detail below, the pump 118 can enable the dispenser 100 to dispense fluid more efficiently and/or can reduce the chance of leakage (compared to certain other types of soap pumps, such as certain soap pumps with gear pumps). In some embodiments, the tube 124 extends from the reservoir 116 to the nozzle 128 and passes through the pump 118. The portion of the tube 124 in the pump 118 can be resilient and/or flexible.

Some configurations can maintain a separation between the interior of the tube 124 and the interior of the pump 118. For example, the liquid passing through the tube 124 can be segregated from and/or kept apart from the interior of the pump 118. In some embodiments, the soap L does not contact an interior of the pump 118 as the soap L passes through the pump 118. In several embodiments, liquid soap L does not directly contact the pump 118. This can aid in reducing problems, such as problems associated with prolonged disuse of the pump 118. In some other soap pumps, with prolonged disuse, soap can dry inside the pump, which can hinder and/or prevent operation of the pump 118. The pump 118 can reduce or avoid such problems by maintaining a separation between the soap L and the pump 118. For example, the soap L can be maintained within the passageway 129. In some embodiments, the maintaining a separation between the soap L and the pump 118 can facilitate the use of soap with particulates (e.g., beads, granules, or otherwise), which could be problematic if not maintained separately. For example, in the context of a gear pump, the particulates could become lodged in and/or bind the gears and/or could increase the time required to prime the pump. The pump 118 can reduce or avoid such concerns.

In some embodiments, the nozzle 128 can be disposed in a manner such that the nozzle 128 extends outwardly from the periphery of the housing 112 of the dispenser 100. For example, as shown in FIG. 8, the housing 112 can include a cantilevered portion that includes the nozzle 128. If a user misses soap dispensed from the nozzle 128, and the soap L falls, it will not strike on any portion of the housing 112. This helps prevent the dispenser 100 from becoming soiled from dripping soap L.

In some embodiments, the nozzle 128 can be mounted on the exterior of the housing 112 of the dispenser 100. For example, the nozzle 128 can be spaced outwardly from an upper portion of the housing 112 of the dispenser 100. In some embodiments, the nozzle 128 is at least partially surrounded by a spout housing 113. The spout housing 113 can at least partially surround the conduit 126. In some embodiments, the spout housing 113 extends from an outer periphery of the housing 112. In some embodiments, the spout housing 113 extends from an upper portion of the housing 112. In some embodiments, the spout housing 113 is integrally formed with the housing 112. In some embodiments, the spout housing 113 can be otherwise connected to the housing 112. For example, the spout housing 113 can be fastened to the housing 112 using any number of mechanical fasteners. In some embodiments, the spout housing 113 is configured to slidably engage a portion of the housing 112 such that the spout housing 113 slides into a recess and/or a slot in the housing 112. In some embodiments, a seal is formed between the spout housing 113 and the housing 112 to inhibit or prevent contaminants from entering the interior of the dispenser 100. In some embodiments, the nozzle 128 can be mounted partially within or completely within the housing 112 of the dispenser 100.

The nozzle 128 can be positioned substantially vertically (e.g., a longitudinal axis of the nozzle forms a substantially right angle with a plane on which the dispenser rests). Such a configuration can, for example, facilitate (e.g., by force of gravity) outflow of the soap L from the nozzle 128. In some implementations, the nozzle 128 can be positioned at another angle. For example, the nozzle 128 can be positioned so as to dispense soap horizontally (e.g., substantially parallel to a plane on which the dispenser 100 rests).

In some implementations, the nozzle 128 includes a one-way valve 150, which can be in the form of a flap-type valve. Such a configuration can, for example, reduce the likelihood that air or contaminants may enter the valve 150, which could lead to improper soap flow from the nozzle 128 and/or drying of soap disposed in the nozzle 128. Of course, other types and/or configurations of one-way valve are contemplated, such as flap valves, ball valves, diaphragm valve, lift valves, other kinds of check valves, and the like.

In some embodiments, the nozzle 128 can include an inlet collar with an interior passage having inlet end and an outlet end. The valve 150 can be formed with at least a deflectable member, such as a flap. In some embodiments, the deflectable member can be configured to move toward an open position when a pressure condition is satisfied. The pressure differential (compared to the ambient pressure acting on an exterior surface of the nozzle 128) at which the deflectable member begins to move toward the open position, and thus the nozzle 128 begins to open, can be referred to as the "cracking pressure." In some embodiments, the cracking pressure can be at least about 0.2 psi and/or equal to or less than about 0.3 psi. In some embodiments, the cracking pressure is less than or equal to about 0.4 psi.

In the illustrated embodiment, the valve 150 includes two slanted deflectable members that form an acute angle with each other. Such a configuration is sometimes referred to as a "duckbill valve". However, a duckbill valve is merely one type of deflectable member valves that can be used as the nozzle 128. Further details regarding the valve 150 and other features can be found in U.S. Pat. No. 9,265,383, issued Feb. 23, 2016, the entirety of which is hereby incorporated by reference herein.

As discussed above, the liquid handling system 114 can include a pump 118. The pump 118 can comprise a high pressure and/or a positive displacement pump for driving a fluid (e.g., soap or air) through the passageway 129. In some embodiments, the pump 118 comprises a peristaltic pump, but other types of pumps 118 are contemplated as well, such as a screw pump, piston pump, diaphragm pump, or otherwise.

Figure 9:
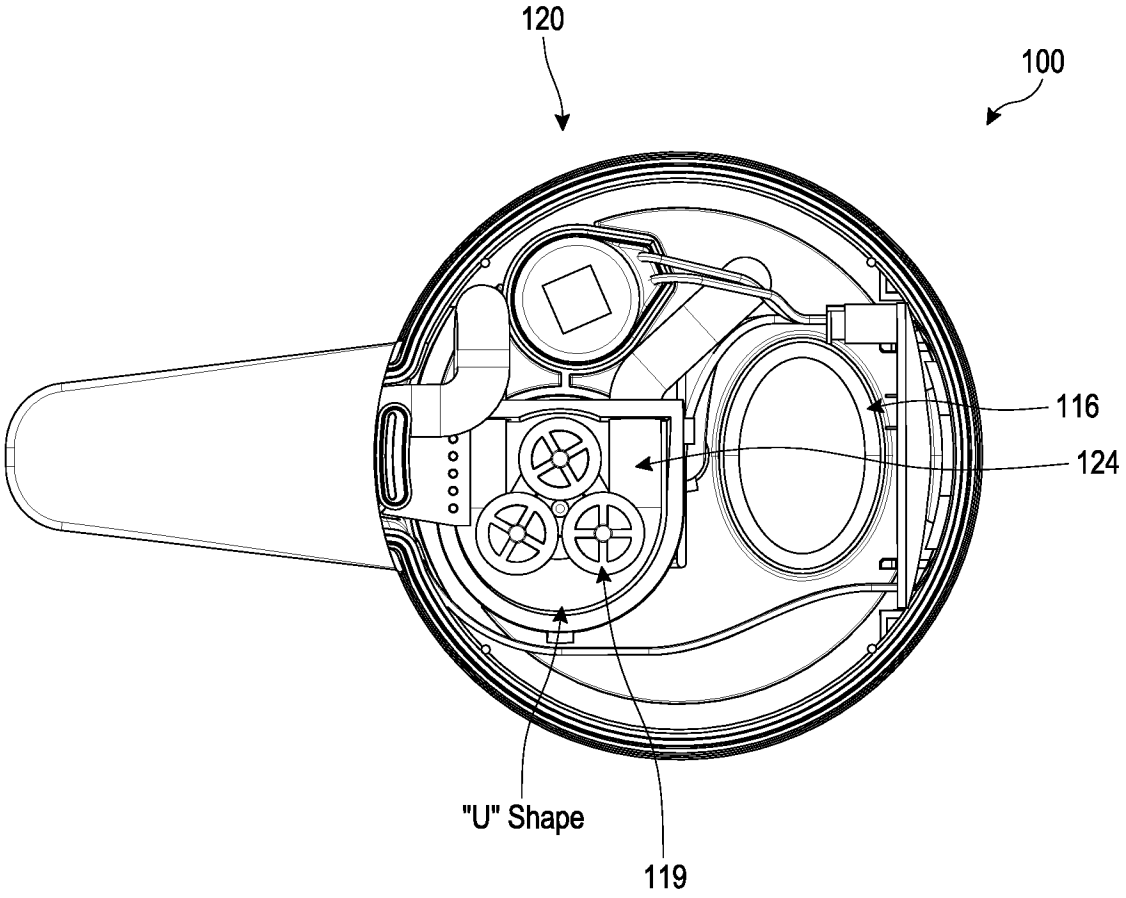
FIG. 9 illustrates a top cross-sectional view of the liquid soap dispenser of FIG. 2.
Figure 10:
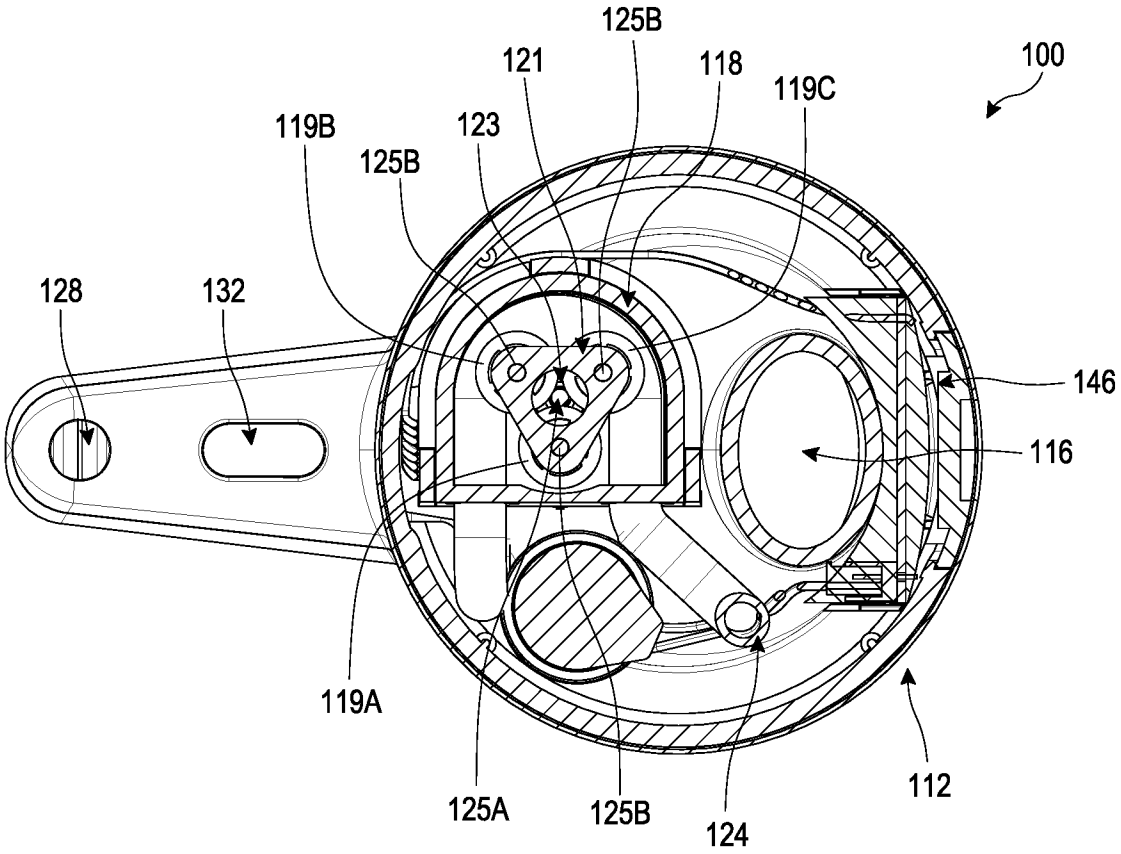
FIG. 10 illustrates a bottom partial cross-sectional view of the liquid soap dispenser of FIG. 2.
Figure 11:
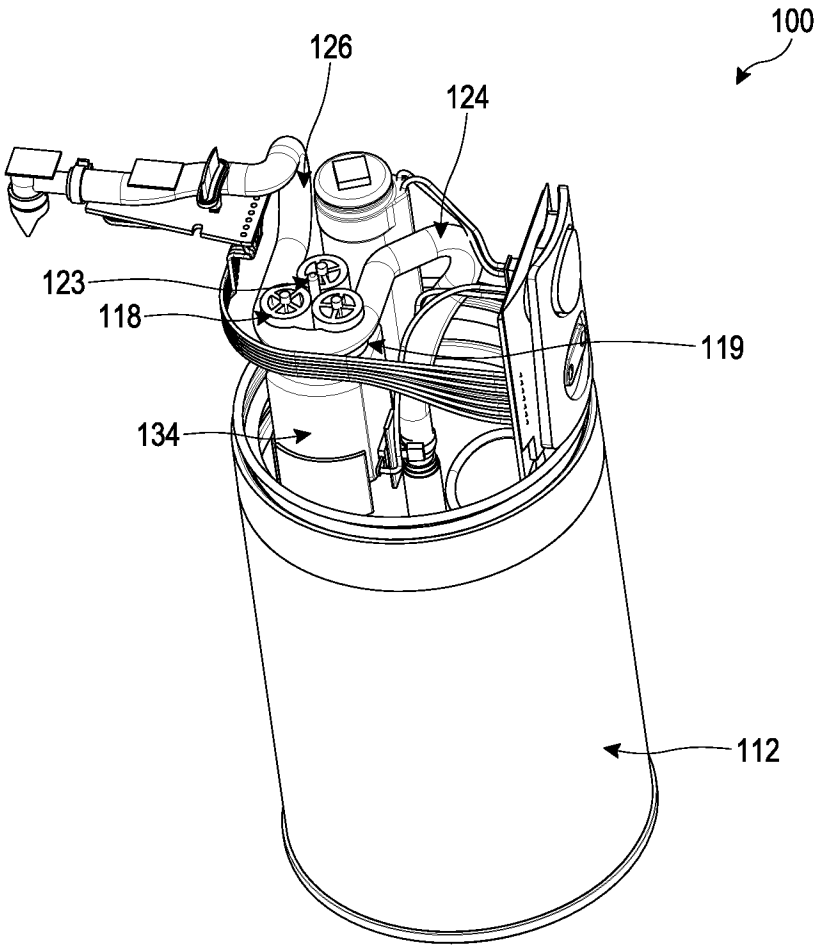
FIG. 11 illustrates a top and side perspective view of the liquid soap dispenser of FIG. 2 without certain features, such as a portion of a housing.
Figure 12:
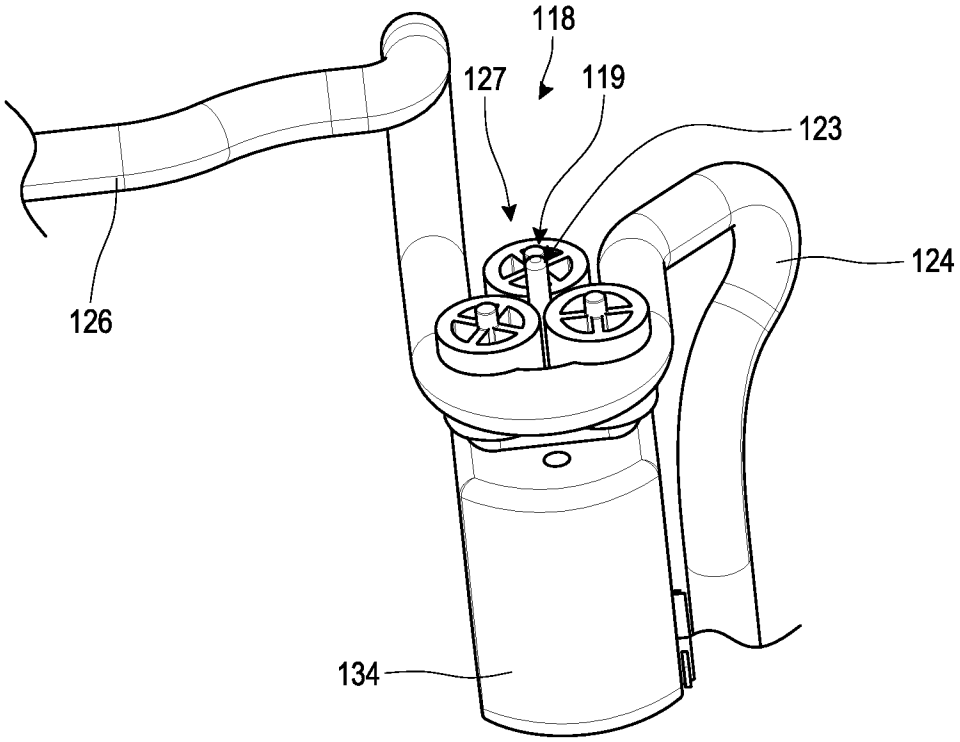
FIG. 12 illustrates an embodiment of a pump and a tube of the liquid soap dispenser of FIG. 2.

In some embodiments, a portion of the passageway 129, such as a portion of the tube 124, passes through the pump 118. In certain implementations, such as is shown in FIG. 9, the tube 124 can form a generally U-shape as the tube 124 passes through the pump 118. In some embodiments, the tube 124 has a cross-sectional shape that is generally: squared, rectangular, triangular, circular, or other shapes. The tube can resilient and/or flexible, such as being able to be radially compressed and expanded without substantial plastic deformation.

As previously mentioned, the pump 118 can be a peristaltic pump. As shown in FIGS. 9-12, the pump 118 can include a pumping feature, such as a roller 119. The pump 118 can include a plurality of rollers 119. The rollers 119 can be secured by a roller cover 121. The roller cover 121 can be connected to a top surface of the rollers 119. In some embodiments, the roller cover 121 is connected to an axle 123 that extends through a center of each of the rollers 119. In some embodiments, the pump 118 can include three rollers 119A, 119B, and 119C. In some embodiments, the pump 118 can include one, two, three, four, five, six, seven and/or eight or more rollers 119. In some embodiments, instead of and/or in combination with the rollers 119, the pump 118 can include a plurality of shoes, wipers, lobes, or other types of features to compress the tube 124.

In some embodiments, the rollers 119 are comprised in a rotor mechanism 127. The rotor mechanism 127 can turn (e.g., rotate) relative to the tube 124. In various embodiments, the rotor mechanism 127 is driven by an actuator 134, such as an electric motor. In some embodiments, an outer circumference of the rotor mechanism 127 can contact and/or compress at least a portion of the tube 124. For example, the rollers 119 can engage (e.g., abut) and compress the tube 124.

The rotor mechanism 127 can be configured such that the rollers 119A, 119B, 119C sequentially contacts and/or compresses at least a portion of the tube 124. For example, the roller 119A can rotate into contact with the tube 124, then the roller 119B can rotate into contact with the tube 124, and then the roller 119C can rotate into contact with the tube 124. In some embodiments, not all of the rollers are in contact with the tube 124 concurrently. For example, in some embodiments, when the roller 119A begins disengaging the tube 124, the roller 119C begins engaging the tube 124. In certain implementations, at any period of time, at least two of the rollers 119 are engaged with the tube 124.

In some embodiments, as the rotor mechanism 127 turns, each of the rollers 119 rotate as well. The turning of the rollers 119 can enable the rollers 119 to roll along and/or turn relative to the tube 124. This can enable the rollers 119 to compress a portion of the tube 124. As the rotor mechanism 127 rotates the rollers 119, and the rollers 119 roll along the tube 124, the compressed portion moves along the length of the tube 124 in the pump 118. The portion of the tube 124 under compression (e.g., by the rollers 119), can occlude or be pinched closed. In some embodiments, the portion of the tube 124 under compression caused by contact with each of the rollers 119 is at least partially pinched closed. This can force the fluid to be pumped to move through the tube 124. As the tube 124 opens to a neutral position (e.g., uncompressed position), after the rotor mechanism 127 passes, fluid flow is induced into the pump 118. In some embodiments, the rollers 119 compress the tube 124 such that at the portion of the tube 124 that is compressed, the diameter of the tube 124 is reduced by approximately 10%, 20%, 30%, 40%, 50%, and/or 60% or more.

As shown in the illustrated embodiment, the pump 118 can include at least three rollers 119A, 119B, 119C. In some embodiments, all three rollers 119A, 119B, 199C can rotate together about a rotor axis of rotation 125A. In some embodiments, the rollers 119A, 119B, 119C can rotate independently about roller axes of rotation 125B and/or an axle that extend through a center of the rollers 119. In some embodiments, the rollers 119A, 119B, 119C rotate independently about a corresponding roller axis of rotation and/or about the rotor axis of rotation simultaneously. The rollers 119 can occlude the tube 124, thereby trapping fluid circumferentially between adjacent rollers 119A, 119B, 119C. As the rollers 119 roll along the tube 124, the trapped fluid can be transported, toward the pump outlet (e.g., towards the conduit 126 and/or the nozzle 128).

The rollers 119 can provide enhanced control of the amount of soap that is dispensed. In some other types of soap dispensers (such as certain dispensers with gear pumps) accurate control of the volume of soap actually dispensed can be difficult, since the pump has a relatively low pressure differential and/or because the pump does not provide discrete pumping amounts. In contrast, the pump 118 can provide a much greater pressure differential and/or can provide discrete pumping amounts. For example, the amount of volume in the tube between adjacent occlusions can be a discrete and known amount, which can enable more accurate control of the dispensation volume. In some embodiments, the pump 118 can provide a pumping pressure of at least about: 0.50 bar, 0.75 bar, 1.0 bar, 1.25 bar, 1.5 bar, 2.0 bar, 2.5, bar, 3.0 bar, or other pressures. In several embodiments, as discussed below, the pump 118 can be positioned near a top of the dispenser 100 and/or near the nozzle 128, which can enhance control of the amount of soap that is dispensed. Accurate control of the dispensation volume can be particularly important in some applications, such as in certain embodiments that are configured to vary the volume of the dispensation amount based on a parameter (e.g., a distance to a detected object), as is discussed in more detail below.

In some embodiments, the pump 118 can be operated in increments depending on the amount of soap to be dispensed. In some configurations, the rollers 119 can rotate through partial revolutions to deliver the required amount of soap. This can facilitate accurate control of the amount of soap dispensed. For example, the amount of rotation by the rollers 119, individually, and/or the rotor mechanism 127 can correspond to an amount of soap to be dispensed. For example, as described above, the rotor mechanism 127 can rotate about a rotor axis and the rollers 119 can rotate independently about a rotor axis extending through a center of each of the rollers 119. The number of revolutions the rotor mechanism 127 turns about the rotor axis and/or the number of revolutions each roller 119 turns about each roller axis can correspond to a particular volume of soap to be dispensed by the dispenser 100. In some embodiments, the amount and/or speed of rotation of the rotor mechanism 127 and/or each of the rollers 119 can correspond to a particular volume of soap to be dispensed.

In some embodiments, the dispenser 100 is configured to reduce the time needed for a user to receive a dispensation of soap and/or the distance that soap must travel to be dispensed from the nozzle 128. In some variants, when the pump 118 is in a resting state (e.g., when no soap is being requested to be dispensed), at least the portion of the tube 124 in contact with one of the rollers 119 remains in a compressed state. This can create a vacuum-like and/or suction effect. For example, soap within the tube 124 can be inhibited or prevented from being pulled by gravity back into the reservoir 116 because of the vacuum. Thus, in some embodiments, when the tube 124 is in the resting state, the tube 124 remains primed with soap. This can reduce the time needed for a user to receive a dispensation of soap and/or the distance that soap must travel to be dispensed from the nozzle 128

In some embodiments, when soap is requested by a user, the rotor mechanism 127 and/or each roller 119 can begin to rotate. For example, the motor 134 can rotate the rotor mechanism 127, which in turn rotates the rollers 119. In some implementations, the rotor 127 and/or the rollers 119 are rotated by an amount that corresponds to the volume of soap to be dispensed. In some embodiments, the rotor mechanism and/or the rollers 119 turn by a predetermined degree of rotation based on a corresponding amount of soap required to be dispensed. For example, the rotor mechanism 127 and/or the rollers 119 turn by a predetermined degree of rotation based on a reading by the sensor 132. In some embodiments, the dispenser 100 only dispenses a certain amount of soap upon activation of the dispenser 100. In some configurations, the rotor mechanism 127 and/or the rollers 119 turn by a predetermined degree of rotation each time the dispenser 100 is activated.

The ECU of the dispenser 100 can control the rotation of the rotor mechanism 127 and/or the rollers 119. In some variants, the ECU may include programming that each full rotation of the rotor mechanism 127 dispenses N units of soap, the ECU can determine or receive a desired volume of soap to be dispensed, and the ECU can control the rotation of the rotor mechanism 127 to dispense a determined or desired amount of soap. For example, in some embodiments, the ECU includes programming that a full rotation of the rotor mechanism 127 dispenses about 3 cc of soap, the ECU can determine or receive the desired volume of soap to be dispensed is 2 cc, and the ECU can control the rotation of the rotor mechanism 127 to rotate ⅔ of a full rotation.

Some embodiments of the dispenser 100 are configured to facilitate quick priming. In certain situations, air may migrate or be pulled into the passage 129, such as when the dispenser 100 has not had soap added to the reservoir 116 for the first time. It is typically desirable to evacuate the air from the passageway 129, such as by driving the air out the nozzle 128. Some embodiments of the dispenser 100 are configured to facilitate this process. This can enhance the accuracy, efficiency, and/or speed of dispensing soap from the dispenser 100.

In some embodiments, the dispenser 100 reduces priming time by automatically filling a portion of the tube 124 with soap. For example, as shown in FIG. 8, a portion of the tube 124 extends into the reservoir 116. When soap is added into the reservoir 116, some of the soap automatically flows into the tube 124. This can result a reduction in the distance that the soap needs to travel to reach the pump 118, and/or in the volume of the tube 124 that contains air rather than soap. As discussed above, a delay can occur between the time soap is requested by the user and the time that soap is dispensed by the dispenser 100. Some embodiments can advantageously reduce such the delay since the tube 124 may already be primed with soap. Thus, when soap is requested by a user, the rotor mechanism 127 and/or the rollers 119 can begin to rotate, causing soap to be dispensed with minimal delay. For example, the time from the pump 118 beginning to operate to soap being dispensed from the nozzle 128 can be less than or equal to about: 50 ms, 100 ms, 0.25 s, 0.5 s, 1 s, or other times. In some variants, the pump 118 comprises a self-priming pump, which is a pump that is configured to use an air-liquid mixture to reach a fully-primed pumping condition. In some embodiments, the pump is configured to reach a primed state in a number of cycles, such as about: 1, 2, 3, 4, 5, or more. In certain implementations, a cycle comprises the rotor mechanism 127 rotating 360° about: 1 time, 2 times, 3 times, 4 times, or more. In some embodiments, a cycle comprises a period that is less than or equal to about: 0.5 s, 0.75 s, 1.0 s, 1.25 s, 1.5 s, 2 s, or other times. To reach a primed state, some variants take less than or equal to about: 1 s, 1.5 s, 2 s, 2.5 s, 3 s, or other times. Some variants prime in about 2 cycles with each cycle lasting about 1 second. In some implementations, a cycle is triggered by an input, such as the sensor 132 detecting an object and/or the user input device 152 being actuated.

Another situation in which air may enter the tube 124 is when an insufficient amount of soap is positioned within the reservoir 116 (e.g., the top of the soap is about equal to or below the opening into the tube 124). When this occurs and the pump 118 is operated, air can be pulled into the tube 124. When additional soap is then added into the reservoir 116, the air in the tube 124 may be trapped and need to be evacuated by a priming operation. In some embodiments, the pump 118 can cause a suction-like effect that causes the newly-added soap to be drawn into and/or suctioned into at least a portion of the tube 124. For example, in some embodiments, newly-added soap can enter at least a portion of the tube 124 automatically as new soap is added to the reservoir 116. In some configurations, the soap may enter into the tube 124 and travel along at least a portion of the tube 124 without rotation of the rotor mechanism and/or the rollers 119. For example, the soap can travel along the tube 124 and enter the pump 118. In some examples, the soap travels along the tube 124 to a point just before the inlet of the pump 118. In some examples, the soap travels along the tube 124 to a portion adjacent the inlet of the tube 124.

In some embodiments, the dispenser 100 is configured such that the pump 118 is able to be primed from a fully empty state to primed state in less than 5 seconds. The term "fully empty state" can indicate that the tube 124 contains no or substantially no soap. The term "primed state" can indicate that the tube 124 contains no or substantially no air. In some embodiments, the dispenser 100 is configured such that the pump 118 is able to be primed from a fully empty state to fully primed state in less than or equal to about: 1 s, 2 s, 5 s, 10 s, 15 s, 20 s, or other times.

Figure 13:
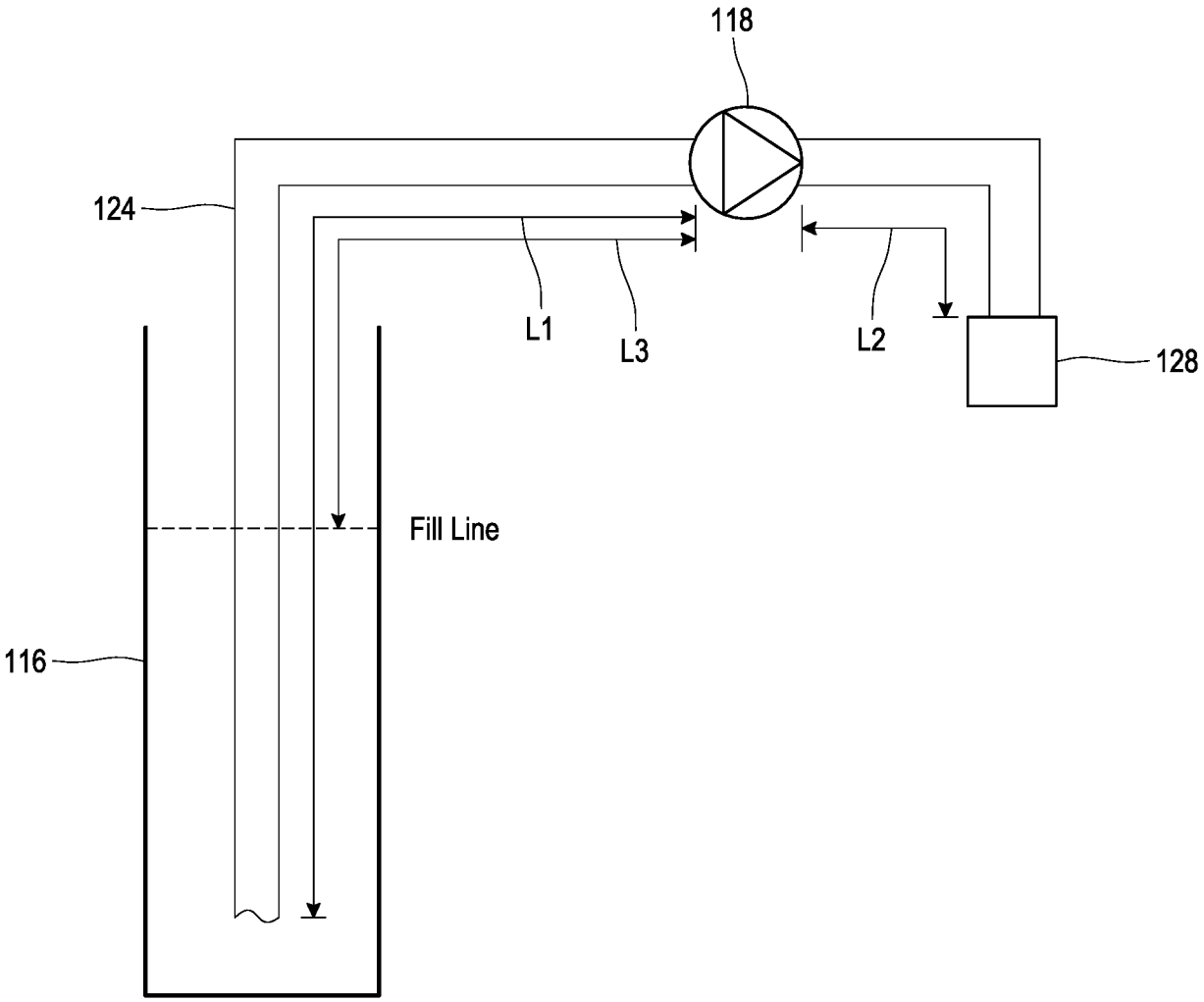
FIG. 13 schematically illustrates a portion of the soap dispenser of FIG. 2.

As discussed above, the pump 118 can be positioned along at least a portion of the passageway 129. In some embodiments, a length and/or volume of the passageway 129 that is downstream of the pump 118 can be less than a length and/or volume of the passageway that is upstream of the pump 118. In some embodiments, when the reservoir 116 is substantially full of soap (e.g., at least about 90% filled), the volume in the passageway downstream of the pump 118 is less than the volume in the passageway upstream of the pump 118. As shown in FIG. 13, for example, the passageway 129 extends from an entry opening of the tube 124 to the nozzle 128. When soap is poured into the reservoir 116, at least some of the soap automatically enters and/or is pulled into the tube 124 from the reservoir 116. This can reduce the length that soap needs to travel through the passageway 129 when a request is received by the dispenser 100 to dispense soap. In some implementations, as shown in FIG. 13, the passageway 129 extends from the opening of the tube 124 to the pump 118 for a length L1. Some embodiments have a fill line (e.g., the point at which the reservoir 116 is at least about 90% full of soap). The passageway 129 can extend from the fill line to the pump 118 for a length L3. As illustrated, L3 is less than L1. This occurs because the soap is automatically pulled into the tube 124 upon filling the reservoir 116. As discussed elsewhere in this disclosure, the compression force applied by the pump 118 on a portion of the tube 124 that passes through the pump 118 can help to maintain the soap level in the tube 124. In various embodiments, the soap does not travel the entire length L1 when soap is requested to be dispensed from the dispenser 100. Instead, the soap can travel beginning at a point spaced away from the opening of the tube 124, within the fluid passageway.

In some embodiments, the fluid passageway extends through one end of the pump to another end of the pump. After passing through the pump, the fluid passageway can extend from an end of the pump to the nozzle 128 (e.g., the location where soap will be dispensed from and/or exit the fluid passageway) for a length L2. In some embodiments, as discussed in more detail below, the pump 118 can be positioned closer to the nozzle 128 than to the bottom of the dispenser 100. This can allow the portion of the fluid passageway extending between the pump 118 and the nozzle 128 to be shorter than the distance between the opening of the tube 124 and the pump 118. For example, as shown in FIG. 13, the length L2 can be shorter than the length L1. In some embodiments, this enables the soap to travel a shorter distance when soap is requested to be dispensed. In some embodiments, L2 can be shorter than L3. In some embodiments, L3 represents a length from the fill line to the pump 118. In some embodiments, L3 represents a length from the level of the soap within the tube 124 when the dispenser is in a resting state. Since the pump 118 enables the soap to be positioned at least partially within the fluid passageway when the dispenser 100 is in the resting state, the soap can travel a shorter length through the fluid passageway to reach the nozzle. This can decrease the amount of time between when the dispenser 100 receives a request to dispense soap and when the dispenser 100 dispenses soap from the nozzle 128. In some embodiments, L2 can be shorter than L1. In some embodiments, L2 can be shorter than L3. In some embodiments in which the soap level is near or at the fill line, L2 can be shorter than L3. In some embodiments in which the soap level is near or at the fill line, L2 can be longer than L3, but shorter than L1.

As shown in FIG. 8, the pump 118 is positioned close to the nozzle 128. This can reduce the distance that soap needs to travel from the pump 118 to the nozzle 128 compared, for example, to having the pump 118 positioned far from the nozzle 128, such as having the nozzle 128 positioned near a top of the dispenser and the pump 118 positioned near a bottom of the dispenser. In some implementations, the lateral distance from the pump 118 to the nozzle 128 is less than or equal to the vertical distance from the pump 118 to the bottom of the dispenser 100. In certain variants, the lateral distance from the pump 118 to the nozzle 128 is less than or equal to the diameter of the dispenser 100. In some embodiments, the pump 118 is positioned above the reservoir 116. In certain implementations, the pump 118 can be positioned approximately in the same plane (e.g., a plane parallel to the surface on which the dispenser rests) as the nozzle 128. In some embodiments, the pump 118 is positioned at least partially below the nozzle 128. In certain variants, the pump 118 is positioned at least partially above the nozzle 128. In some implementations, the pump 118 is positioned in an upper ½ of the dispenser, an upper ⅓ of the dispenser, and/or an upper ¼ of the dispenser 100. In some embodiments, the pump 118 is positioned near a mid-section of the dispenser 100. In some embodiments, the pump 118 is positioned near the plane of the nozzle 128. Thus, the pump 118 can be positioned closer to the top of the dispenser 100 than the bottom of the dispenser 100. In some embodiments, the pump 118 can require less space within the dispenser 100. Such configurations can allow the dispenser 100 to be smaller.

In some embodiments, the location of the pump 118 can facilitate efficient operation of the dispenser 100. For example, in certain embodiments with the pump 118 disposed closer to the top of the dispenser than to the bottom of the dispenser, the pump 118 can reduce the amount of power needed to pump fluid through the tube 124 (compared to, for example, the pump being positioned closer to the bottom of the dispenser than to the top of the dispenser). For example, less power may be required to pump soap from the reservoir 116 to the nozzle 128 since the pump 118 can be positioned closer to the nozzle 128 than to the bottom of the reservoir 116. Thus, the soap can travel a shorter overall route and/or a shorter length of the tube 124 may need to be primed before dispensing soap.

As discussed above, the pump 118 may require less time to prime the tube 124 in use. The pump 118 can create a suction-like environment in which at least some soap is pulled into the tube 124 from the reservoir 116 in a resting state. When the pump 118 is in a resting state, soap can remain within the tube 124 since the rollers maintain engagement with the tube 124 and compress at least a portion of the tube 124. Thus, the pump 118 may more efficiently prime the tube 124 and/or require less power to prime the tube 124 before dispensing soap through the nozzle 128.

Certain examples of the pump 118 described herein can lengthen the life of the power supply 160. For example, less power may be required by the pump 118 to dispense soap, as discussed above. Thus, the power supply 160 can be used to dispense a greater volume of soap. In some configurations, the user can request soap to be dispensed a greater number of times before the power supply 160 is replaced and/or recharged. In some embodiments, a smaller power supply 160 (e.g., in power storage amount) may be used.

FIGS. 14-17

FIGS. 14-17 illustrate another embodiment of a dispenser 200. The dispenser 200 can be similar or identical to the dispenser 10, 100 discussed above in many respects. Accordingly, numerals used to identify features of the dispenser 200 are incremented by a factor of one hundred to identify certain similar features of the dispenser 10, 100. For example, as shown in FIGS. 14-17, the dispenser 200 can include a housing 212 that at least partially contains a liquid handling system 214. The liquid handling system 214 can include a reservoir, a pump, and a discharge assembly. The housing 212 and the liquid handling system 214, which includes the reservoir, the pump, and the discharge assembly can be respectively similar to the housing 12, 112 and the liquid handling system 14, 114, which includes the reservoir 16, 116, the pump 18, 118, and the discharge assembly 20, 120 described above in connection with the dispenser 10, 100. The dispenser 200 can include any one, or any combination, of the features of the dispenser 10, 100. Similarly, the dispensers 10, 100 can include any one, or any combination, of the features of the dispenser 200. For example, the dispenser 100 can include the sensor and dispensation adjustment features described below.

In some embodiments, the dispenser 200 has a sensor device 232. The sensor 232 can be configured to emit a trigger signal used to control operation of a motor or an actuator. In some embodiments, the sensor 232 can be an interrupt-type sensor. The sensor 232 can be triggered when a body part is disposed in the path of a beam of light 244 or some other mechanism interrupts the light beam 244. In some embodiments, the sensor 232 can be a proximity sensor or a reflective type sensor that is configured to send a different signal to the ECU based on the distance between an object and the sensor. For the purposes of simplifying the examples described below, a hand H is used to trigger the sensor 232, but any number of other objects or mechanisms could be used to trigger the sensor 232.

The sensor 232 can be positioned along any portion of the housing surface or the sensor can be a separate component. As shown in FIGS. 14-17, the sensor 232 can be on an upper portion 210 of the soap dispenser 200. The sensor 232 can be positioned along a surface that is generally transverse to the longitudinal axis of the soap dispenser. The sensor 232 can be positioned near a nozzle 228. The sensor 232 can be positioned such that the sensor detects the hand H when the hand is positioned under the nozzle 228.

In some embodiments, the dispenser 200 can include one or more sensing regions 241 to trigger one or more sensor devices 232. If a signal is detected in a sensing region, the sensor can trigger the dispenser to perform a specific operation based on the particular signal. For example, the specific operation may vary based on the distance between a hand H and the sensor 232, and/or other parameters such as angle, duration, repetition, path of motion, and/or speed of motion. All descriptions of changing dispensing performance based on sensing regions included herein can be applied for use with these or other parameters besides or in addition to sensing regions.

The one or more sensing regions 241 may take on any shape, width, height, or length. The one or more sensing regions 241 can be positioned in any number of configurations in relation to each other and the dispenser 200 and are not limited to the regions depicted in FIGS. 14-17. In some embodiments, a first sensing region 241*a* can be positioned adjacent to or near a second sensing region 241*b*; while in some embodiments, the first sensing region 241*a* is not positioned adjacent to or near the second sensing region 241*b*. The first and second sensing regions 241*a*, 241*b* can be disposed in proximity to any portion of the housing 212. In some embodiments, one or more sensing regions 241 are positioned in an area that is between the nozzle 228 and the lower portion 211, while in some embodiments, one or more sensing regions 241 are positioned in an area that is above the upper portion 210 of the dispenser 200.

The one or more sensing regions 241 can be used in any type of configuration that allows the user to control an aspect of the operation of the dispenser 200. For example, the one or more sensing regions 241 can be used to trigger the dispenser 200 to dispense different volumes of liquid L, activate different duty cycle characteristics, dispense at different speeds, operate for varying durations of time, or other appropriate parameters. The examples below will be explained in the context of a dispenser 200 configured to dispense different volumes of liquid, but the dispenser can be configured to dispense liquid with one or more of any of the outputs described above.

These features allow the same touch-free dispenser to be used by different users who may desire different outputs or by the same user for different purposes without requiring direct physical contact between the hands and a physical pump switch or other adjustment. For example, an adult and a child can use the same dispenser to obtain a volume of liquid soap that is proportional to their hand size or the same person can adjust the volume of soap dispensed depending on how dirty his/her hands are. A user can also use the same touch-free soap dispenser to wash his/her hands or wash a kitchen sink full of dishes.

Figure 14:
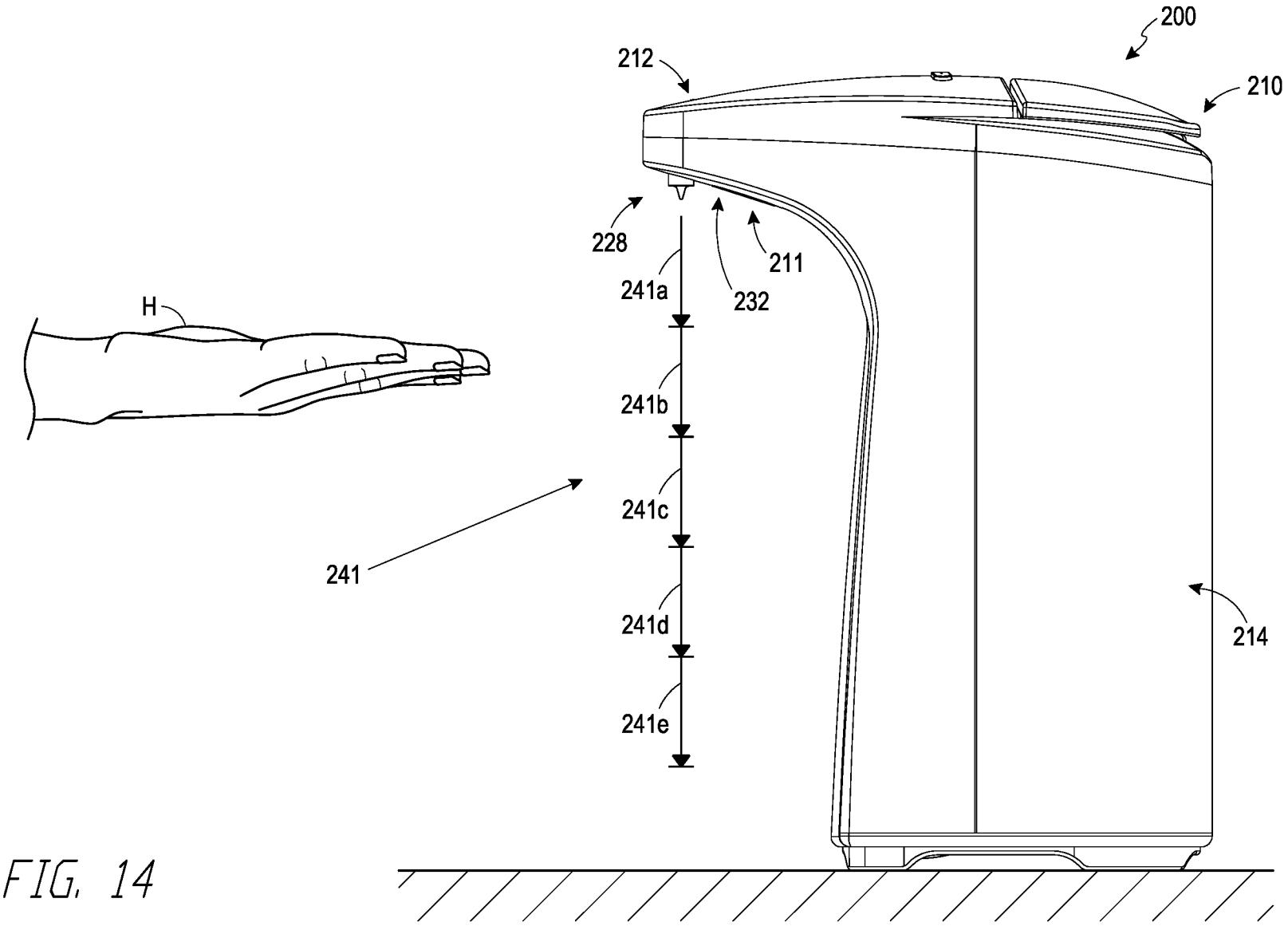
FIGS. 14-17 illustrate an embodiment of a soap dispenser with multiple sensing regions.
Figure 15:
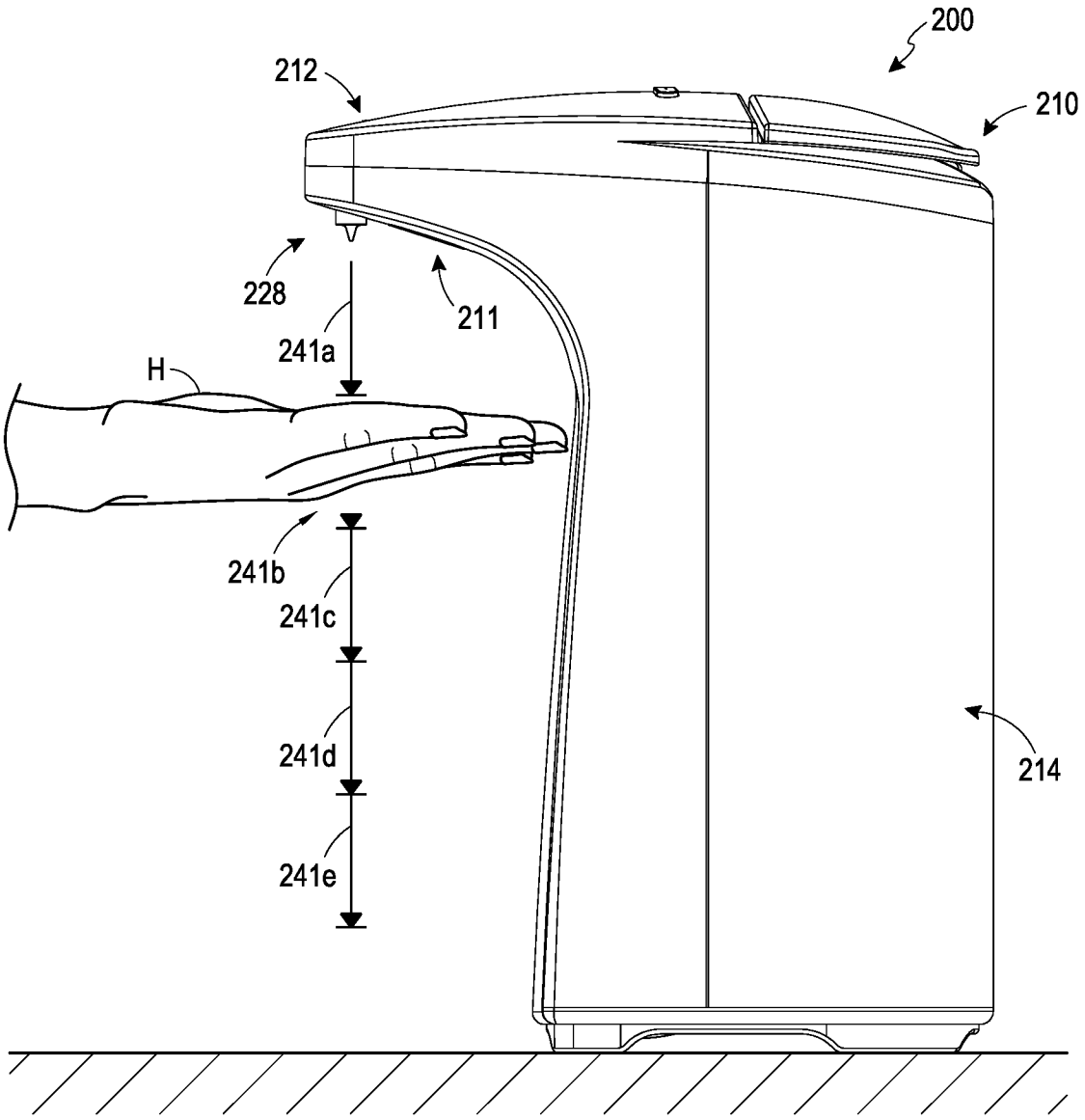
Figure 16:
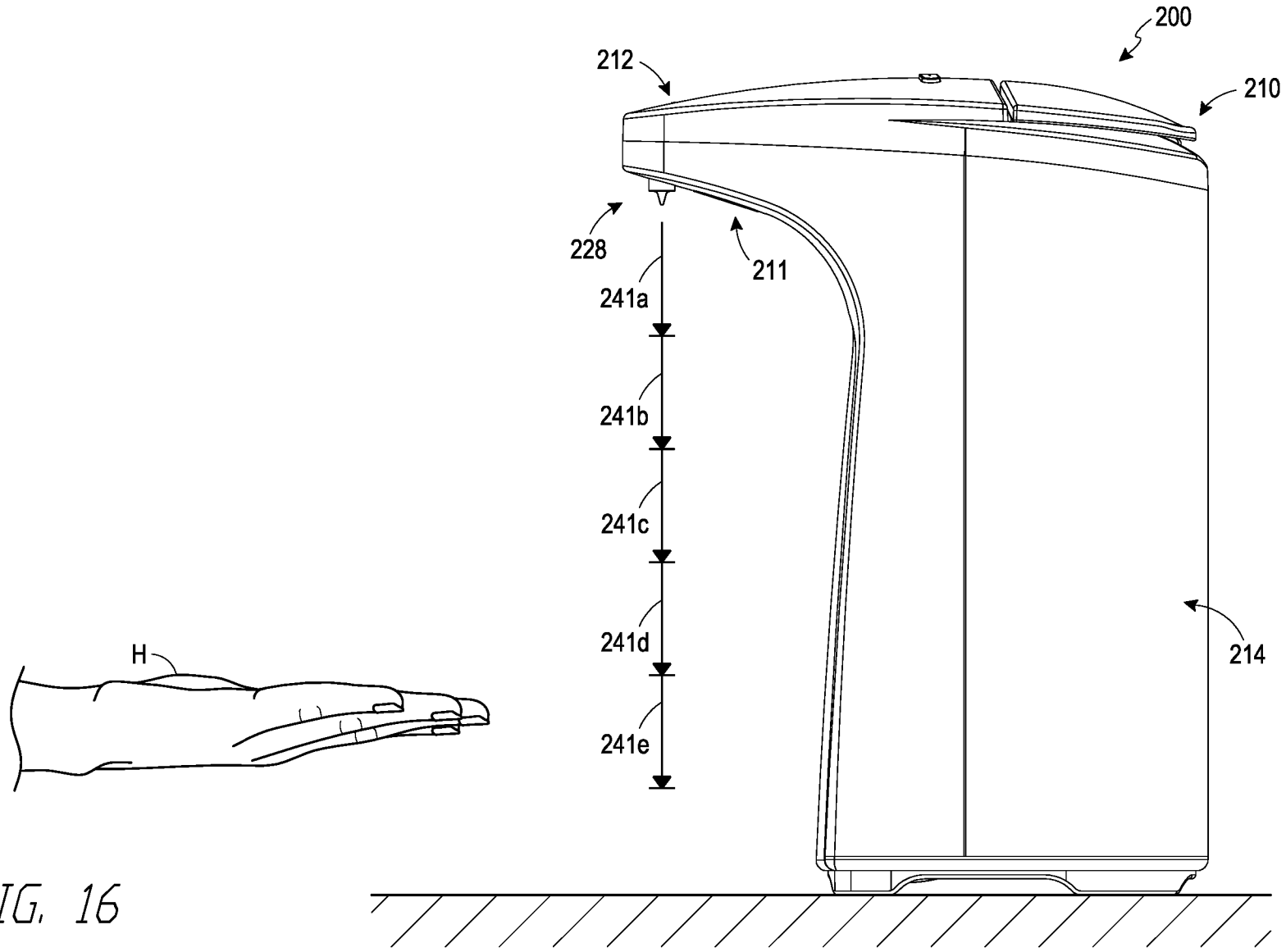
Figure 17:
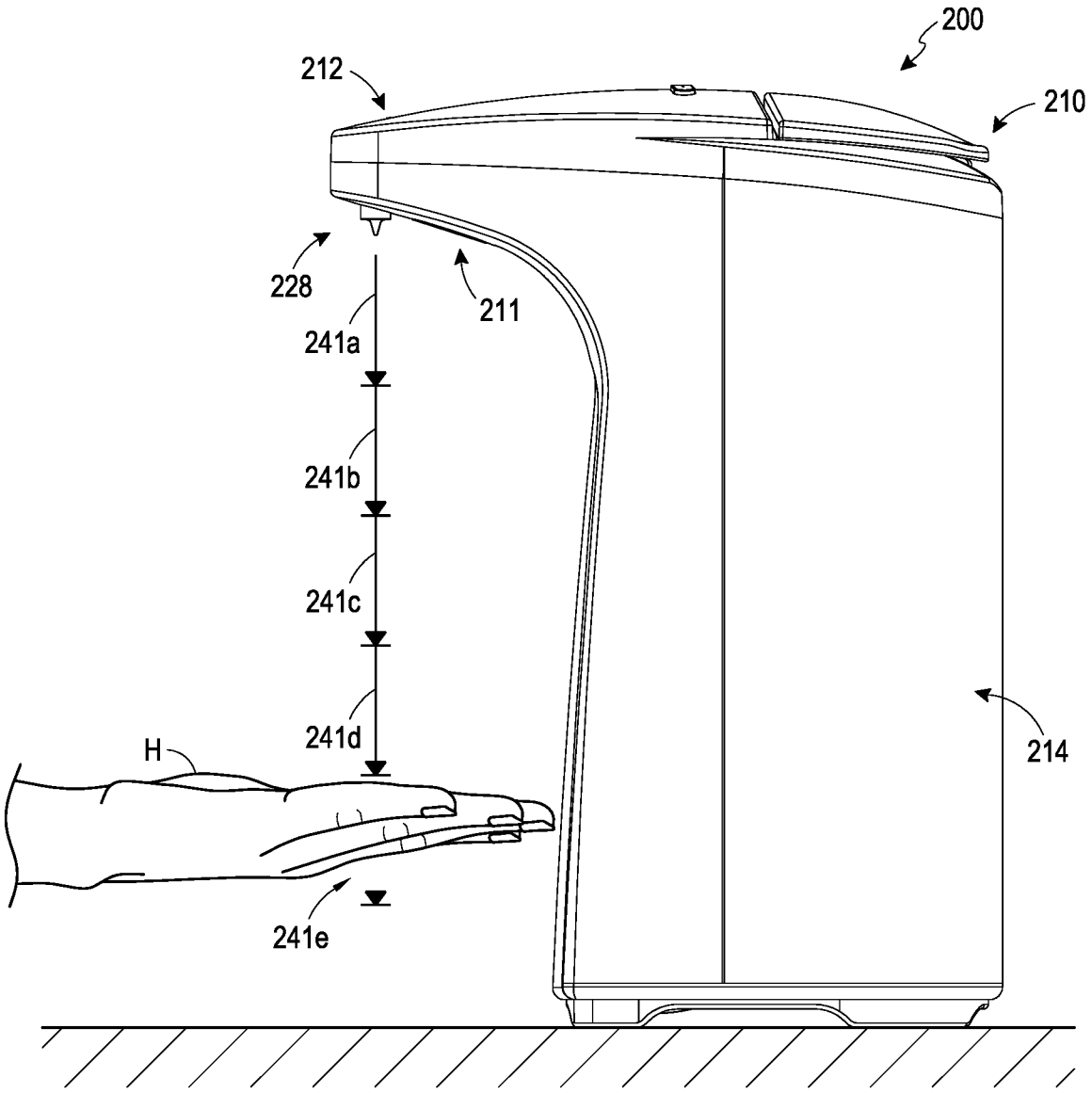

In several embodiments, the one or more sensing regions 241 can be configured to allow a user to select different volumes of liquid L to be dispensed from the nozzle 228 during each dispensation cycle. As shown in FIGS. 14 and 16, no liquid is dispensed when no signal is detected within any of the sensing regions 241. On the other hand, in FIGS. 15 and 17, a predetermined volume of liquid L is dispensed when a signal is detected within one of the sensing regions 241. As illustrated in FIG. 15, when a signal is detected in a sensing region 241*b*, the sensor 232 triggers the dispenser 200 to dispense a first predetermined volume of liquid L1 from the nozzle 228. In FIG. 17, when a signal is detected in a different sensing region 241*e*, the sensor triggers the dispenser to dispense a second predetermined volume of liquid L2 from the nozzle 228 that is different from the first volume of liquid L1.

In some embodiments, when a signal indicating that an object is disposed in a first region (e.g., relative to the sensor) is received, a first volume of liquid dispensed. In some embodiments, when a signal indicating that an object is disposed in a second region (e.g., further from the sensor than the first region) is received, a second volume of liquid is dispensed. In certain embodiments, the second volume is larger than the first volume. One or more additional sensing regions and liquid volumes can be used. In certain implementations, the volume of liquid dispensed is related (e.g., linearly, exponentially, or otherwise) to the distance from the sensor to the object. For example, in certain embodiments, the volume of liquid dispensed increases as the distance from the sensor to the object increases. In some embodiments, the volume of liquid dispensed decreases as the distance from the sensor to the object increases.

In some embodiments, the one or more sensing regions are positioned in a manner that corresponds with natural human conduct or instinct. For example, a child may be more inclined to hold his/her hands closer to the nozzle, so, in some embodiments, a sensing region positioned closer to the nozzle would dispense a smaller volume of liquid than a sensing region positioned further away from the nozzle.

In some embodiments, the volume of dispensed liquid does not depend solely or at all on the length of time that the object remains in the sensing region. The dispensed volumes can differ depending on the location of the object (e.g., hand) in a different sensing region, even if certain other parameters are the same (such as the length of time that the object is sensed in a region).

In some embodiments, the dispenser 200 includes an algorithm configured to send a command to trigger the dispenser to dispense different volumes of liquid based on the detected signal. For example, the algorithm can send a command to trigger the dispenser to dispense a first predetermined volume of liquid L1 if a signal is detected in a first sensing region 241*a*, or the algorithm can send a command to trigger the dispenser to dispense a second pre-determined volume of liquid L2 if a signal is detected in the second sensing region 241*b*.

In some embodiments, the algorithm can incorporate a delay that deactivates the sensor or otherwise prevents the dispenser from dispensing liquid immediately after the dispenser dispenses liquid. The delay may be may be for 1 second, 5 seconds, or any other amount of time. The delay helps prevent the user from unintentionally triggering the dispenser. For example, after the user triggers the dispenser to dispense liquid, the algorithm commands the sensor to deactivate for the delay period. During the delay period, the dispenser will not dispense liquid even if an object is in a sensing region during the delay period. If the user places his/her hand in a sensing region after the delay period, the dispenser will dispense liquid again.

In some embodiments, the one or more sensing regions 241 can be used for allowing a user to select different modes of dispensing liquid L. When a signal is detected in the first sensing region 241*a*, the sensor 232 triggers the dispenser 200 to dispense a first predetermined volume of liquid L1 in normal mode. In normal mode, the dispenser 200 is configured to dispense a pre-determined volume of liquid L1 suitable for washing a user's hands. When a signal is detected in the second sensing region 241*b*, the sensor 232 triggers the dispenser 200 to dispense liquid L in extended chore mode. In extended chore mode, the dispenser 200 is configured to continuously dispense and/or an increased amount (e.g., a maximum predetermined amount of liquid). This may be helpful if, for example, the user wishes to fill a sink full of soapy water for washing dishes. In some embodiments, the volume of dispensed liquid does not depend solely or at all on the length of time that the object remains in the sensing region. In some embodiments, the dispenser 200 may continue to dispense liquid as long as a hand is detected in second sensing region 241*b*.

In some embodiments, the dispenser 200 may have a first and second sensing regions 241 configured to operate in normal mode, and a third sensor region configured to operate in extended chore mode. In some embodiments, the one or more sensing regions 241 can be positioned in a manner that corresponds with natural human conduct or instinct. For example, a user may not want to place his/her hand underneath the nozzle to activate the extended chore mode if the user does not want soap on his/her hands. Thus, the sensing region associated with extended chore mode may be positioned above the upper portion of the dispenser 200 or in proximity to the housing in an area that is not in the path of dispensed liquid.

In some embodiments, the dispenser 200 includes an algorithm configured to send a command to trigger the dispenser to dispense liquid in normal mode, extended chore mode, or any other mode. For example, the algorithm can send a command to trigger the dispenser to dispense a liquid in normal mode if a signal is detected in a first sensing region 241*a*, or the algorithm can send a command to trigger the dispenser to dispense a liquid in extended chore mode if a signal is detected in the second sensing region 241*b*.

In some embodiments, the one or more sensing regions 241 correspond with different types of dispensing liquid. For example, when a signal is detecting in the first sensing region 241*a*, the sensor 232 triggers the dispenser 200 to dispense a first type of liquid, such as soap. When a signal is detected in the second sensing region 241*b*, the sensor 232 triggers the dispenser 200 to dispense a second type of liquid, such as lotion.

In some embodiments, the dispenser 200 includes an algorithm configured to send a command to trigger the dispenser 200 to dispense different types of liquid based on the detected signal. For example, the algorithm can send a command to trigger the dispenser 200 to dispense a first type of liquid, such as soap, if a signal is detected in a first sensing region 241*a*, or the algorithm can send a command to trigger the dispenser 200 to dispense a second type of liquid, such as lotion, if a signal is detected in the second sensing region 241*b*.

In some embodiments, the dispenser 200 only comprises one sensing region. The dispenser 200 can be configured to dispense varying volumes of liquid, based on the signal detected in the sensing region. For example, the dispenser 200 can dispense a first amount of liquid if the hand is positioned at a first angle in the sensing region, and the dispenser 200 can dispense a second amount of liquid if the hand is positioned at a second angle in the sensing region. In another example, the dispenser 200 can dispense a first amount of liquid if the hand performs a first motion in the sensing region, and the dispenser 200 can dispense a second amount of liquid if the hand performs a second motion in the sensing region.

In some embodiments, the dispenser 200 comprises a first sensing region and a second sensing region, and the dispenser is configured to dispense a predetermined volume of liquid, depending on the angle of the hand or the hand motion in a first sensing region or a second sensing region.

In some embodiments, the dispenser 200 may comprise a mechanism to calibrate the different sensing regions with different output characteristics as desired by the user. For example, a user could configure a first sensing region to correspond with a first user-selected volume of liquid L1 and a second sensing region to correspond with a second user-selected volume of liquid L2. In another example, the user could adjust the size (e.g., width or height) of the sensing region. The user could designate a first user-selected sensing region to correspond with a first pre-determined volume of liquid L1 and designate a second user-selected sensing region to correspond with a second pre-determined volume of liquid L2. This calibration mode can be triggered by pressing a button, activating a sensor, or any other appropriate mechanisms.

In some embodiments, the volume dispensed from the dispenser 100 varies from a first volume V1 to a second volume V2, such as based on the distance to a detected object (e.g., a user's hand). In certain implementations, the first volume V1 is less than the second volume V2. In some variants, the first volume V1 is greater than or equal to the second volume V2. In certain implementations, the first volume V1 is about: 0.25 mL, 0.50 mL, 0.75 mL, 1.0 mL, 1.5 mL, or other volumes. In some variants, the second volume V2 is about: 2.0 mL, 2.5 mL, 3.0 mL, 3.4 mL, 4.0 mL, 4.5 mL, or other volumes. In some embodiments, the sensing time (e.g., of an infrared signal reflected back from a detect object) corresponding to dispensation of the first volume V1 is about: 100 ms, 150 ms, 200 ms, 250 ms, 300 ms, or other times. In some embodiments, the sensing time corresponding to dispensation of the second volume V2 is about: 700 ms, 800 ms, 900 ms, 1 s, 1.1 s, or other times. In some implementations, the smallest soap volume output (e.g., when the sensor is triggered by an object that is near the nozzle) is about 0.5 mL and/or the sensing time is about 200 ms. In certain variants, the largest soap volume output (e.g., when the sensor is triggered by an object near the bottom of the dispenser and/or at around 10 cm away from the sensor) is about 3.4 mL and/or the sensing time is about 900 ms. In some implementations, the dispenser 100 is configured to dispense larger amounts of soap as the distance from the sensor to the object increases. In some variants, the dispenser 100 is configured to dispense larger amounts of soap as the distance from the sensor to the object decreases.

Certain Terminology

Terms of orientation used herein, such as "top," "bottom," "horizontal," "vertical," "longitudinal," "lateral," and "end" are used in the context of the illustrated embodiment. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular" or "cylindrical" or "semi-circular" or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

The terms "approximately," "about," and "substantially" as used herein represent an amount close to the stated amount that still performs a desired function or achieves a desired result. For example, in some embodiments, as the context may permit, the terms "approximately", "about", and "substantially" may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may permit, the term "generally parallel" can refer to something that departs from exactly parallel by less than or equal to 20 degrees. As another example, in certain embodiments, as the context may permit, the term "generally perpendicular" can refer to something that departs from exactly perpendicular by less than or equal to 20 degrees.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B, and C" can include a first processor configured to carry out recitation A working in conjunction with a second processor configured to carry out recitations B and C.

The terms "comprising," "including," "having," and the like are synonymous and are used inclusively, in an open-ended fashion, and do not exclude additional elements, features, acts, operations, and so forth. Likewise, the terms "some," "certain," and the like are synonymous and are used in an open-ended fashion. Also, the term "or" is used in its inclusive sense (and not in its exclusive sense) so that when used, for example, to connect a list of elements, the term "or" means one, some, or all of the elements in the list.

Overall, the language of the claims is to be interpreted broadly based on the language employed in the claims. The language of the claims is not to be limited to the non-exclusive embodiments and examples that are illustrated and described in this disclosure, or that are discussed during the prosecution of the application.

SUMMARY

Although the soap dispenser has been disclosed in the context of certain embodiments and examples, it will be understood by those skilled in the art that the soap dispenser extends beyond the specifically disclosed embodiments to other alternative embodiments and/or uses of the embodiments and certain modifications and equivalents thereof. For example, some embodiments can be configured to use a fluid other than soap, e.g., hand sanitizer, shampoo, hair conditioner, skin moisturizer or other lotions, toothpaste, or other fluids. It should be understood that various features and aspects of the disclosed embodiments can be combined with or substituted for one another in order to form varying modes of the soap dispenser. Accordingly, it is intended that the scope of the soap dispenser herein-disclosed should not be limited by the particular disclosed embodiments described above, but should be determined only by a fair reading of the claims that follow.

The following is claimed:

1. A liquid dispenser comprising:

a housing;

a reservoir configured to store a liquid;

a conduit comprising a flexible tube disposed in the housing, wherein the flexible tube has an inlet and an outlet;

a lid engaged with the housing, the lid configured to be moved to an open position to provide access to an opening in the reservoir through which the liquid can be introduced into the reservoir, wherein the lid and housing at least partly bound an interior of the liquid dispenser;

a pump disposed within the interior and above the reservoir, wherein the pump is a peristaltic pump that comprises:

a rotor including a plurality of rollers, wherein the rotor has a rotor rotational axis, wherein each of the plurality of rollers has a roller rotational axis, and wherein each of the plurality of rollers is configured to rotate about the rotor rotational axis and the roller rotational axis, wherein each of the plurality of rollers is configured to contact the flexible tube such that each of the plurality of rollers compresses a portion of the flexible tube that is in contact with the roller;

a motor disposed in the housing, wherein the motor is configured to drive the pump to cause the liquid to move through the flexible tube;

a first sensor configured to generate a signal based on a distance between an object and the first sensor; and an electronic processor configured to receive the signal from the first sensor and to determine a dispensation volume of the liquid, the dispensation volume varying as a function of the distance between the object and the first sensor, the processor further configured to control the motor to dispense approximately the dispensation volume of the liquid;

wherein the pump is disposed within the housing such that a length of the conduit that is positioned downstream of the pump is shorter than a length of the conduit that is positioned upstream of the pump.

2. The liquid dispenser of claim 1, wherein the liquid includes liquid soap.

3. The liquid dispenser of claim 1, wherein the pump is positioned closer to a top of the housing than a bottom of the housing.

4. The liquid dispenser of claim 1, further comprising a nozzle configured to allow the liquid to be dispensed.

5. The liquid dispenser of claim 4, wherein the pump is positioned adjacent a plane extending generally perpendicular to a vertical axis of the nozzle.

6. The liquid dispenser of claim 4, wherein the pump is positioned closer to the nozzle than to a bottom of the liquid dispenser.

7. The liquid dispenser of claim 1, wherein when the reservoir is substantially full of liquid, a volume of the liquid in the flexible tube downstream of the pump is less than a volume of the liquid in the flexible tube upstream of the pump.

8. The liquid dispenser of claim 1, wherein the roller includes at least three rollers.

9. The liquid dispenser of claim 1, wherein each of the plurality of rollers is configured to contact the flexible tube such that each of the plurality of rollers compresses a portion of the flexible tube that is in contact with the roller.

10. The liquid dispenser of claim 1, wherein the flexible tube extends from the reservoir to the nozzle and passes through the pump.

11. The liquid dispenser of claim 1, wherein the peristaltic pump is configured to provide a pumping pressure of at least about 1.0 bar.

12. The liquid dispenser of claim 1, wherein the electronic processor is configured to send the signal to the motor by generating a first signal to dispense a first volume of the liquid when the object is within a first distance from the first sensor, and generating a second signal to dispense a second volume of the liquid when the object is within a second distance from the first sensor, wherein the first volume is smaller than the second volume and the first distance is less than the second distance.

13. The liquid dispenser of claim 1, wherein the liquid dispenser is configured to reach a primed state in about 2 cycles of the pump.

14. The liquid dispenser of claim 1, wherein the liquid dispenser is configured to reach a primed state in less than or equal to about 2.5 seconds.

15. The liquid dispenser of claim 1, further comprising a power supply connection that is configured to engage with a power supply cord, the power supply connection comprising an engaging element that is configured to magnetically couple, in multiple orientations, with a corresponding engaging element of the power supply cord.

16. The liquid dispenser of claim 15, wherein the housing comprises a cylindrical peripheral shape.

17. The liquid dispenser of claim 1, wherein the housing comprises a lower portion that is configured to support the housing on a countertop.

18. A liquid dispenser comprising:

a housing;

a reservoir having an interior configured to store a liquid;

a conduit having a flexible tube and an opening in fluid communication with the interior of the reservoir;

a lid engaged with the housing, the lid configured to be moved to an open position to provide access to an opening in the reservoir through which the liquid can be introduced into the reservoir, wherein the lid and housing at least partly bound an interior of the liquid dispenser;

a pump positioned within the interior of the liquid dispenser and above the reservoir, the pump comprising:

a plurality of rollers, each of the plurality of rollers being configured to contact the flexible tube such that each of the plurality of rollers compresses a portion of the flexible tube that is in contact with the roller, and wherein the pump is disposed within the housing such that a length of the conduit that is positioned downstream of the pump is shorter than a length of the conduit that is positioned upstream of the pump.

19. The dispenser of claim 18, further comprising:

a first sensor configured to generate a signal based on a distance between an object and the first sensor; and an electronic processor configured to receive the signal from the first sensor and to determine a dispensation volume of the liquid, the dispensation volume varying as a function of the distance between the object and the first sensor, the processor further configured to control the motor to dispense approximately the dispensation volume of the liquid.

20. The dispenser of claim 18, further comprising a motor disposed in the housing, wherein the motor is configured to drive the pump configured to cause a liquid to move through the flexible tube.

21. The dispenser of claim 18, wherein the flexible tube is configured to create a seal between the liquid from the pump such that the liquid does not contact the pump.

22. The dispenser of claim 18, wherein the liquid comprises liquid soap.

23. The dispenser of claim 18, wherein the reservoir is configured such that, when additional liquid is added into the reservoir, at least a portion of the liquid in the reservoir automatically moves into the conduit without operation of the pump.

24. The dispenser of claim 18, wherein the number of revolutions of each of the plurality of rollers about a rotational axis corresponds to a volume of liquid that is dispensed.

25. The dispenser of claim 18, wherein the portion of the flexible tube that is in contact with the roller remains compressed when no liquid is dispensed.

26. The dispenser of claim 18, wherein the dispenser is configured to reach a primed state in about 2 cycles of the pump.

27. The dispenser of claim 18, wherein the dispenser is configured to reach a primed state in less than or equal to about 2.5 seconds.

28. The liquid dispenser of claim 18, wherein the liquid dispenser is not configured to be embedded in a countertop.

29. The liquid dispenser of claim 18, wherein the liquid dispenser is configured such that, when liquid is added into the reservoir, some of the liquid automatically flows into the conduit, thereby reducing the volume of the conduit that contains air to be removed during a priming operation.

* * * * *